United States Patent [19]

Takada et al.

[11] Patent Number: 4,770,985

[45] Date of Patent: Sep. 13, 1988

[54] SILVER HALIDE PHOTOGRAPHIC MATERIAL

[75] Inventors: Shun Takada; Takashi Kadowaki; Masao Sasaki; Toyoki Nishijima; Kaoru Onodera, all of Odawara, Japan

[73] Assignee: Konishiroku Photo Industry Co., Ltd., Tokyo, Japan

[21] Appl. No.: 115,649

[22] Filed: Oct. 26, 1987

Related U.S. Application Data

[63] Continuation of Ser. No. 904,779, Sep. 5, 1986, abandoned, which is a continuation of Ser. No. 716,043, Mar. 26, 1985, abandoned.

[30] Foreign Application Priority Data

Mar. 29, 1984 [JP] Japan ..... 59-61556
Mar. 29, 1984 [JP] Japan ..... 59-62887

[51] Int. Cl.[4] ..... G03C 1/08; G03C 1/46; G03C 7/26; G03C 7/32

[52] U.S. Cl. ..... 430/505; 430/553; 430/555; 430/557; 430/558

[58] Field of Search ..... 430/505, 553, 555, 557, 430/558

[56] References Cited

U.S. PATENT DOCUMENTS

| | | | |
|---|---|---|---|
| 2,895,826 | 7/1959 | Salmimen | 430/384 |
| 3,772,002 | 11/1973 | Ramello | 430/553 |
| 4,009,035 | 2/1977 | Kojima et al. | 430/384 |
| 4,299,914 | 11/1981 | Fujimatsu et al. | 430/384 |
| 4,456,681 | 6/1984 | Kadowaki et al. | 430/558 X |
| 4,536,472 | 8/1985 | Kato et al. | 430/558 X |

FOREIGN PATENT DOCUMENTS

| | | |
|---|---|---|
| 0142086 | 5/1985 | European Pat. Off. . |
| 0156377 | 10/1985 | European Pat. Off. . |
| 2431480 | 1/1975 | Fed. Rep. of Germany . |

*Primary Examiner*—Mukund J. Shah
*Attorney, Agent, or Firm*—Jordan B. Bierman

[57] ABSTRACT

A silver halide photographic material is disclosed which has formed on a support in sequence a silver halide emulsion layer incorporating a yellow coupler of the formula (I), a silver halide emulsion layer incorporating a magenta coupler of the formula (II), and a silver halide emulsion layer incorporating a cyan coupler of the formula (III):

(I)

wherein $R_1$ is a hydrogen atom, a halogen atom or an alkoxy group; $R_2$ is $-NHCOR_3$, $-NHSO_2R_3$, $-COOR_3$ or $$-SO_2\underset{\underset{R_4}{|}}{N}-R_3,$$

provided that $R_3$ and $R_4$ are each an alkyl group; and $Z_1$ is a non-metallic atomic group necessary to form a 5- or 6-membered hetero ring together with a nitrogen atom);

(II)

[wherein $R_5$ is a hydrogen atom, a halogen atom or an alkoxy group having 1 to 4 carbon atoms; $R_6$ is (provided that $R_7$ and $R_8$ are each a hydrogen atom or an acyl group, and when $R_7$ and $R_8$ are each an acyl group, they may be combined to form a 5-membered hetero ring together with a nitrogen atom), an alkyl- or arylsulfonamido group, an alkyl- or arylsulfamoyl group or an alkyl- or arylcarboxylic acid ester group; $Y_1$, $Y_2$, and $Y_3$ are each a hydrogen atom, a halogen atom, an alkyl group, an alkoxy group, a carboxy group, an alkoxycarbonyl group, a nitro group, an aryloxy group, a cyano group or an acylamino group; and $Z_2$ is an atom or a group that leaves when it enters into a coupling reaction with the oxidation product of a color developing agent];

(III)

(wherein $R_9$ is a straight- or branched-chain alkyl group having 2 to 4 carbon atoms; and $R_{10}$ is a ballast group).

8 Claims, No Drawings

SILVER HALIDE PHOTOGRAPHIC MATERIAL

This application is a continuation of application Ser. No. 904,779, filed Sept. 5, 1986, now abandoned, which in turn is a continuation of application Ser. No. 716,043, filed Mar. 26, 1985, now abandoned.

BACKGROUND OF THE INVENTION

The present invention relates to a silver halide photographic material. More particularly, the invention relates to a silver halide photographic material which uses a specified cyan coupler so as to provide a cyan dye image having improved resistance to discoloration both in light and dark places, thereby achieving a balanced discoloration between yellow, magenta and cyan colors.

Silver halide color photographic materials typically comprise a support having formed thereon three silver halide emulsion layers selectively sensitized to have sensitivity to blue, green and red lights. For example, in color negative photographic materials, blue-, green- and red-sensitive silver halide emulsion layers are formed on a support, with the blue-sensitive emulsion layer being positioned on the top and closest to a light source for the purpose of exposure. The blue- and green-sensitive emulsion layers are interposed by a bleachable yellow filter layer which absorbs a blue light transmitted through the blue-sensitive emulsion layer. Other intermediate layers that are intended for achieving certain purposes are disposed between each emulsion layer while a protective layer is formed as the outermost layer. In photographic materials used as color papers, red-, green- and blue-sensitive silver halide emulsion layers are formed on a support, with the red-sensitive emulsion layer being positioned the closest to a light source for the purpose of exposure. As in color negative photographic materials, a UV absorbing layer and other intermediate layers for achieving various purposes are formed, as well as a protective layer. The emulsion layers may be arranged in different orders, and it is also common for each emulsion layer to be replaced by at least two emulsion layers which have substantially the same sensitive region for a particular light but which have different degrees of sensitivity to such light. With all types of silver halide color photographic materials, aromatic primary amine compounds are typically used as colored developing agents so as to develop exposed silver halide grains, and the resulting oxidation product of the color developing agent reacts with a dye forming coupler so as to form a dye image. In order to produce cyan, magenta and yellow dye images, a phenolic or naphtholic cyan coupler, a 5-pyrazolone pyrazolinobenzimidazole, pyrazolotriazole, indazolone or cyanoacetyl magenta coupler and an acylacetamide or benzoylmethane yellow coupler are respectively used. These dye forming couplers are incorporated in sensitive, color photographic emulsion layers.

Silver halide photographic materials bearing the dye images thus formed are stored under exposure to light for an extended period and may experience discoloration. The same problem occurs if the photographic materials are stored in a dark place under certain conditions. The first type of discoloration is generally referred to as "light discoloration" whereas the second type is called "dark discoloration". In order to store color photographic materials semipermanently, the degree of light and dark discoloration should be minimized and the overall balance in the coloration of yellow, magenta and cyan dye images must be held as close as possible to the initial state. However, these three dye images suffer different degrees of light and dark discoloration and, after extended storage, the overall balance in the discoloration of the three colors is upset and quality of the respective dye images is deteriorated.

Two different approaches are being taken in the attempts being made to solve this problem: one is to develop a new coupler capable of forming a dye image that suffers less discoloration, and the other is to develop a new additive capable of preventing undesired discoloration. Methods using the second approach are characterized by incorporating a UV absorber or forming a UV absorbing filter in a color photographic material. However, in order to provide a satisfactory degree of light fastness with a UV absorber, the latter must be used in a fairly large amount, but then the dye image is considerably stained by the UV absorber or the latter forms a precipitate without being completely dissolved in a high-boiling solvent. Another problem is caused by the fact that the UV absorber is degraded if the dye image is exposed to a strong actinic radiation for an extended period, and the deteriorated UV absorber enhances, rather than inhibits, the discoloration of the dye image.

The UV absorber is not effective in preventing discoloration resulting from visible light, so anti-discoloration agents other than UV absorbers have also been proposed. Among such agents that have a phenolic hydroxyl group or a group that is hydrolyzed to form a phenolic hydroxyl group are bisphenols (Japanese Patent Publication Nos. 31256/1973 and 31625/1973), pyrogallol, gallic acid and esters or acyl derivatives thereof (U.S. Pat. No. 3,069,262), 6-hydroxychromans (U.S. Pat. Nos. 3,432,300 and 3,574,627), 5-hydroxychroman derivatives (U.S. Pat. No. 3,573,050) and 6,6'-dihydroxy-bisspirochromans (Japanese Patent Publication No. 20977/1974). However, some of these agents are entirely ineffective against dark discoloration and, in an extreme case, they enhance such dark discoloration although they can effectively inhibit the light discoloration of a dye image. Other agents retain their intended effects for a certain period but during extended storage of the dye image of interest, their effects are rapidly decreased or lost entirely. A strain problem may also be caused by such anti-discoloration agents. Several of such agents are effective against the discoloration of a magenta dye image but they accelerate appreciably the discoloration of a cyan dye image.

Considerable effort is also being made in the art to develop new couplers capable of forming dye images that suffer less discoloration. As already mentioned, in order to ensure extended or semi-permanent storage of formed yellow, magenta and cyan dye images, they must have a good color balance. Even if these dye images are exposed to light for an extended period or if they are stored in a dark place under a hot and humid condition, they should suffer little or no discoloration. However, the degree of light and dark discoloration varies among yellow, magenta and cyan dye images. As for dark discoloration, a cyan dye image is the most vulnerable, then comes a yellow dye image, and a magenta dye image is most resistant. It is worth a particular mention that the degree of discoloration in the cyan dye image is most greater than in the other dye images. As for light discoloration, the cyan dye image is also the most vulnerable and the magenta dye image is the most resistant, assuming a light source having a high content of UV radiation.

It is therefore concluded that in order to retain a good balance in the discoloration of yellow, magenta and cyan colors for an extended period, the light and dark discoloration of a cyan dye image must be reduced to a minimum, and this is why the development of a new type of cyan coupler that is less likely to cause light or dark discoloration is strongly desired.

Conventional cyan couplers such as those shown in Japanese Unexamined Published Patent Application Nos. 37425/1972, 10135/1975, 25228/1975, 112038/1975, 117422/1975, 130441/1975, and U.S. Pat. Nos. 2,369,929, 2,423,730, 2,434,272, 2,474,293 and 2,698,794 easily suffer both light and dark discolorations, and color photographic materials bearing cyan dye images produced from these couplers cannot be stored for an extended period without upsetting the overall balance in the discoloration of yellow, magenta and cyan colors. In order to solve this problem, various other cyan couplers have been studied and 2,5-diacylamino compounds have recently come to be used (see U.S. Pat. No. 2,895,826 and Japanese Unexamined Published Patent Application Nos. 112038/1975, 109630/1978 and 163537/1980). Cyan couplers made of these compounds have an appreciably improved resistance to dark discoloration but are still unsatisfactory in terms of resistance to light discoloration.

SUMMARY OF THE INVENTION

Therefore, one object of the present invention is to provide a silver halide photographic material that retains a good balance in the discoloration of yellow, magenta and cyan dye images even if the material is stored either under prolonged exposure to light or in a dark place, and which hence exhibits dye images of good quality over an extended period of storage.

Another object of the present invention is to provide a silver halide photographic material that incorporates a cyan coupler capable of producing a cyan dye image having improved resistance to both light and dark discolorations.

A further object of the present invention is to provide a silver halide photographic material that forms a cyan dye image having an appreciably improved resistance to both light and dark discolorations and which hence displays a good overall balance among the yellow, magenta and cyan colors even if the material is exposed to light or is left in a hot and humid atmosphere for an extended period.

These and other objects of the present invention will become apparent by reading the following detailed description.

DESCRIPTION OF THE PREFERRED EMBODIMENT

The objects stated above of the present invention can be accomplished by a silver halide photographic material having formed on a support in sequence a silver halide emulsion layer incorporating a yellow coupler of the formula (I), a silver halide emulsion layer incorporating a magenta coupler of the formula (II), and a silver halide emulsion layer incorporating a cyan coupler of the formula (III):

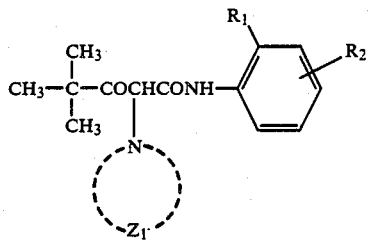

(I)

(wherein $R_1$ is a hydrogen atom, a halogen atom or an alkoxy group; $R_2$ is $-NHCOR_3$, $-NHSO_2R_3$, $-COOR_3$ or

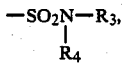

provided that $R_3$ and $R_4$ are each an alkyl group; and $Z_1$ is a non-metallic atomic group necessary to form a 5- or 6-membered hetero ring together with a nitrogen atom);

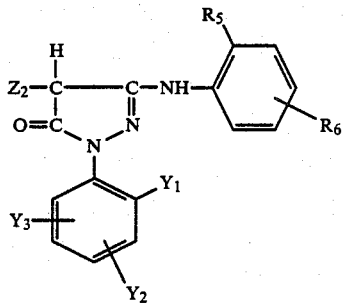

(II)

[wherein $R_5$ is a hydrogen atom, a halogen atom or an alkoxy group having 1 to 4 carbon atoms; $R_6$ is

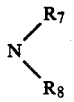

(provided that $R_7$ and $R_8$ are each a hydrogen atom or an acyl group, and when $R_7$ and $R_8$ are each an acyl group, they may be combined to form a 5-membered hetero ring together with a nitrogen atom), an alkyl- or arylsulfonamido group, an alkyl- or arylsulfamoyl group or an alkyl- or arylcarboxylic acid ester group; $Y_1$, $Y_2$ and $Y_3$ are each a hydrogen atom, a halogen atom, an alkyl group, an alkoxy group, a carboxy group, an alkoxycarbonyl group, a nitro group, an aryloxy group, a cyano group or an acylamino group; and $Z_2$ is an atom or a group that leaves when it enters into a coupling reaction with the oxidation product of a color developing agent];

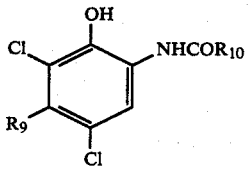

(III)

(wherein $R_9$ is a straight- or branched-chain alkyl group having 2 to 4 carbon atoms; and $R_{10}$ is a ballast group).

The symbol $R_1$ in formula (I) represents a hydrogen atom, a halogen atom or an alkoxy group, and examples of the halogen are chlorine, bromine and fluorine, with the chlorine atom being preferred. Examples of the alkoxy group represented by $R_1$ include those having a straight- or branched-chain alkyl moiety of 1 to 5 carbon atoms, such as a methoxy, ethoxy, propoxy, i-propoxy, butoxy and t-butoxy, with methoxy and ethoxy being preferred. The alkyl moiety in such alkoxy groups may have one or more substituents.

The symbol $R_2$ in formula (I) represents —$NHCOR_3$, —$NHSO_2R_3$, —$COOR_3$ or $$-SO_2\underset{\underset{R_4}{|}}{N}-R_3,$$

wherein $R_3$ and $R_4$ each represents a straight- or branched-chain alkyl group having 1 to 25 carbon atoms, and specific examples include octyl, nonyl, decyl, dodecyl, hexadecyl and octadecyl. The alkyl groups represented by $R_3$ and $R_4$ may have a substituent such as aryloxy, alkoxycarbonyl, alkylsulfonyl, sulfonate, aryl and alkylamide.

The non-metallic atomic group represented by $Z_1$ in formula (I) may comprise carbon atoms, oxygen atoms, nitrogen atoms or sulfur atoms. Examples of the 5- or 6-membered hetero ring formed by such non-metallic atomic group together with a nitrogen atom include 2,5-dioxoimidazolidine, 2,3,5-trioxoimidazolidine, 2,5-dioxotriazolidine, 3,5-dioxotriazolidine, 2,4-oxozolidinediontriazolidine, 2,4-thiazolidinediontriazolidine, pyridone, pyrimidone, pyrazone, tetrazolone, tetrazole, imidazole, triazole, imidazolone, triazolone, pyrazolone, isothioazolone, quinaoxazolone, benzoxazolone, isoxazolone and fluorone. Preferred hetero rings are 2,3-dioxoimidazolidine, 2,3,5-trioxoimidazolidine, 3,5-dioxotriazolidine, 2,4-oxazolidinediontriazolidine, imidazole, imidazolone and triazolone. Useful groups including these hetero rings are shown in U.S. Pat. Nos. 3,408,194, 3,419,391, Japanese Unexamined Published Patent Application Nos. 132926/1975, 102636/1976, 48541/1979, 28834/1975, 10736/1974, 112343/1976, 105820/1976, 20826/1976, 122955/1975, 62454/1980, 3207/1980, 34232/1975, 117423/1975, 9828/1976, 18315/1977, 105226/1978, 112038/1975 and 52423/1978.

Typical example of the yellow coupler represented by formula (I) are listed below.

Y-1

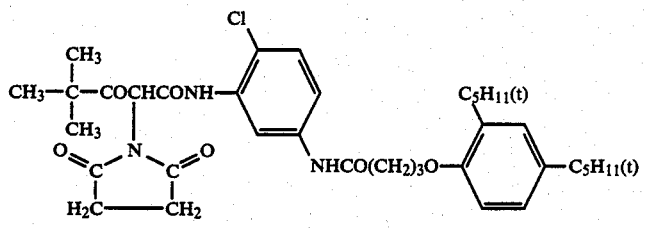

Y-2

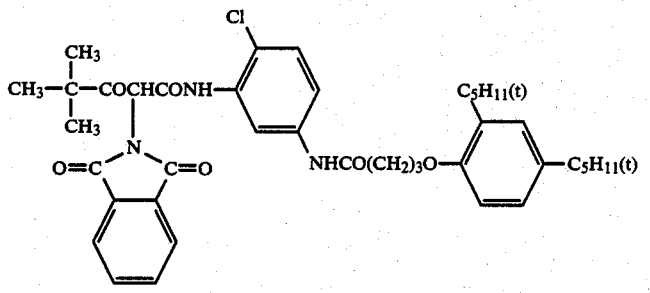

Y-4

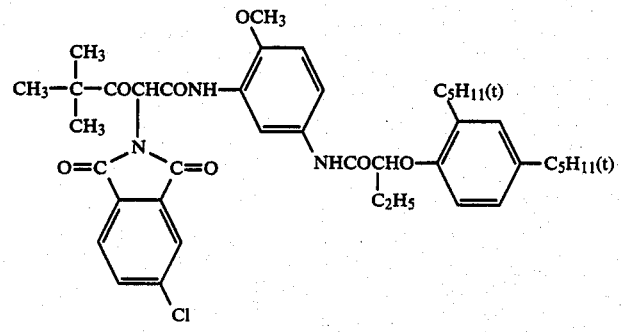

-continued
Y-5
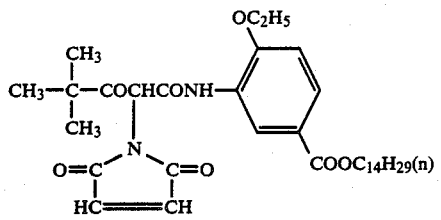
Y-6
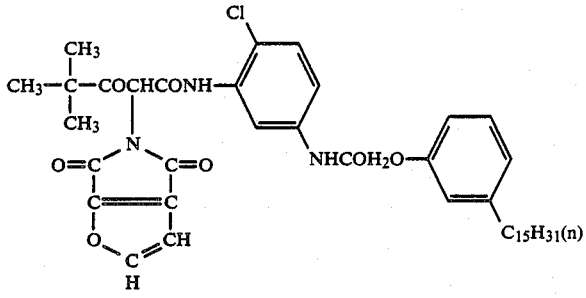
Y-7
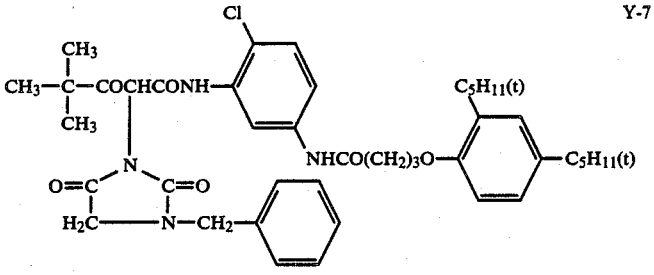
Y-8
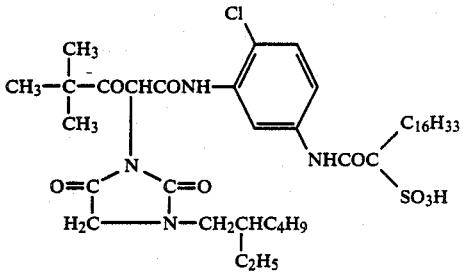
Y-9
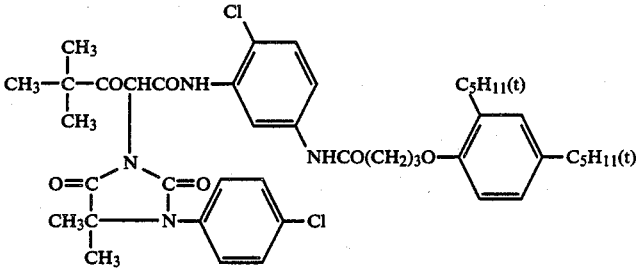
Y-10
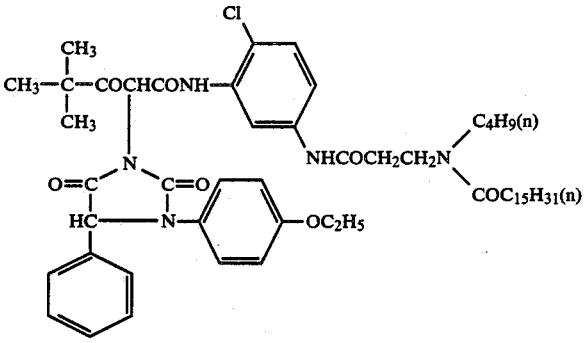
Y-11
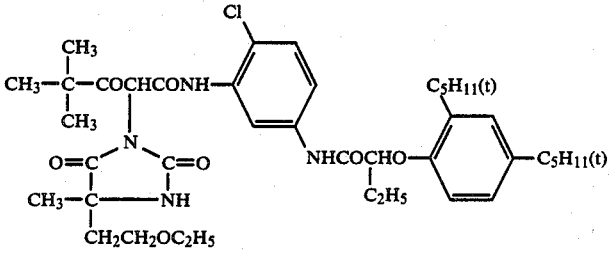

-continued
Y-12
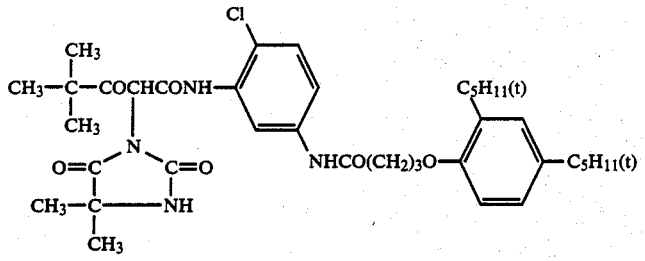
Y-13
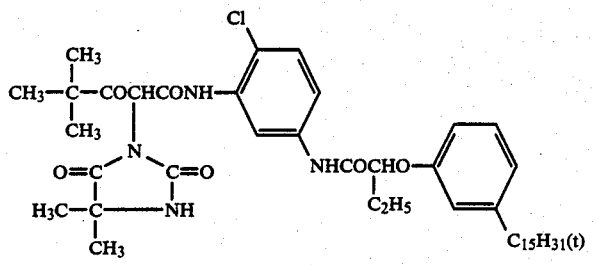
Y-14
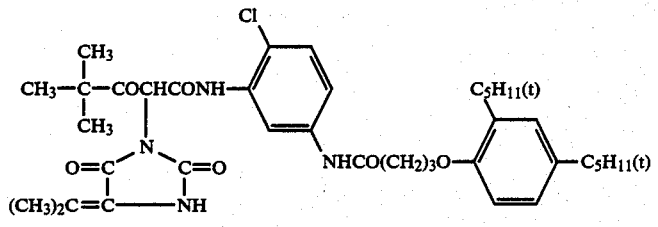
Y-15
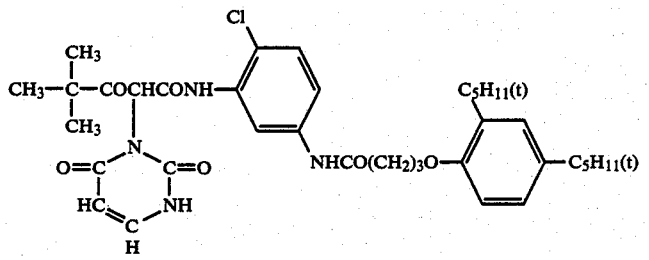
Y-16
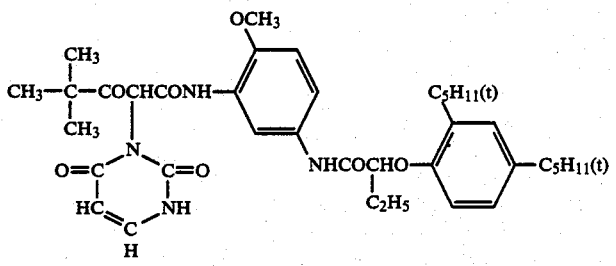
Y-17
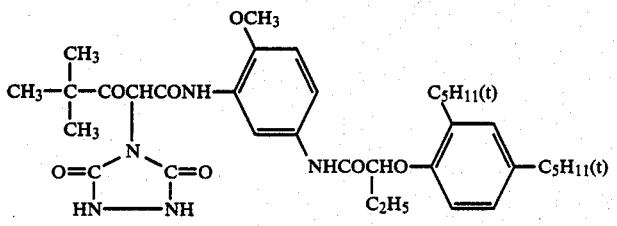

-continued
Y-18
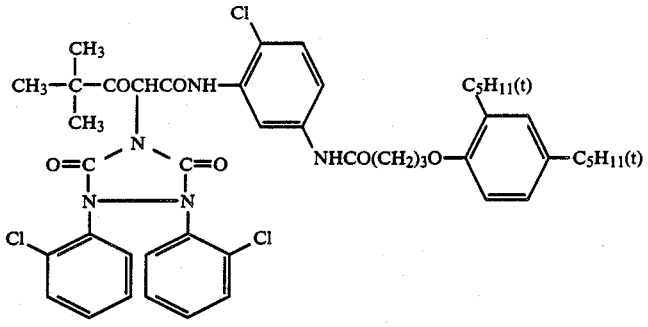
Y-19
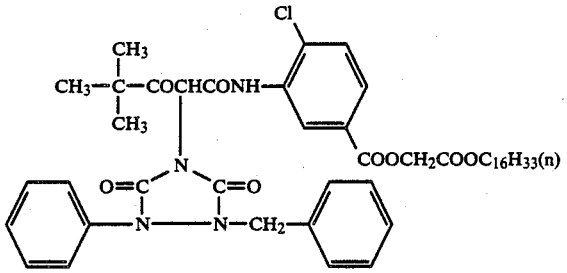
Y-20
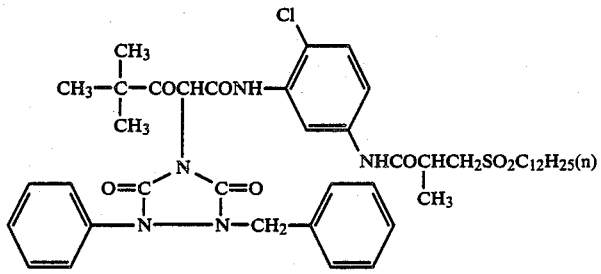
Y-21
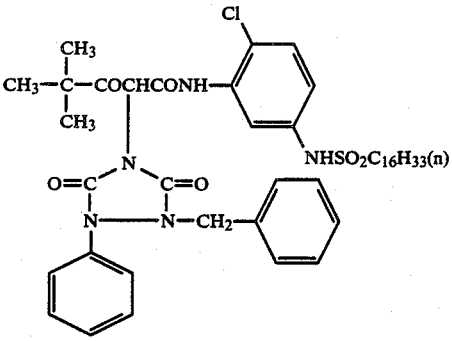
Y-22
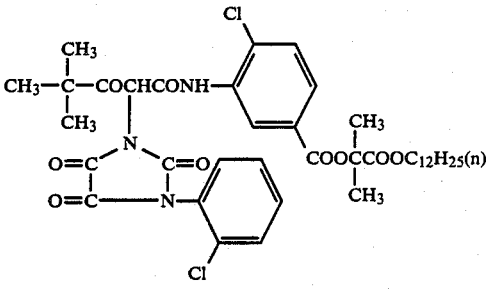
Y-23
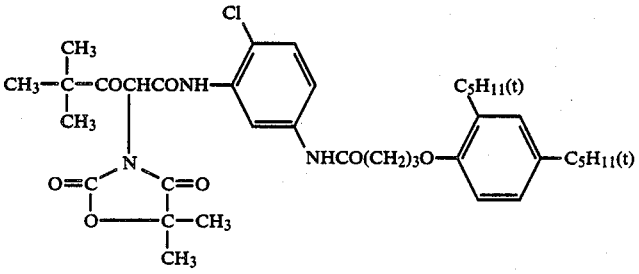

-continued
Y-24
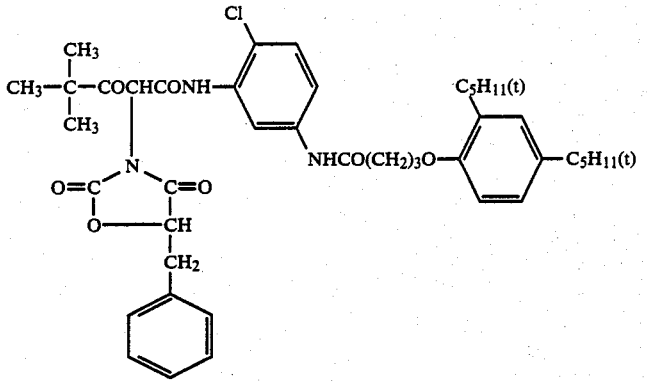
Y-25
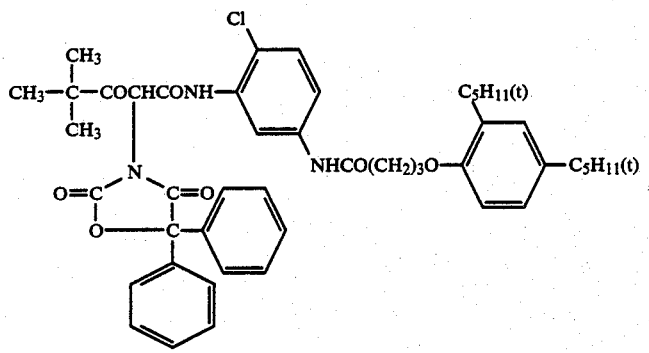
Y-26
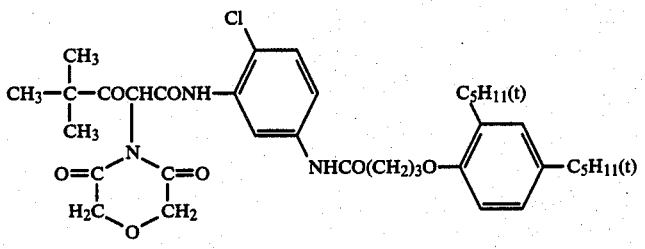
Y-27
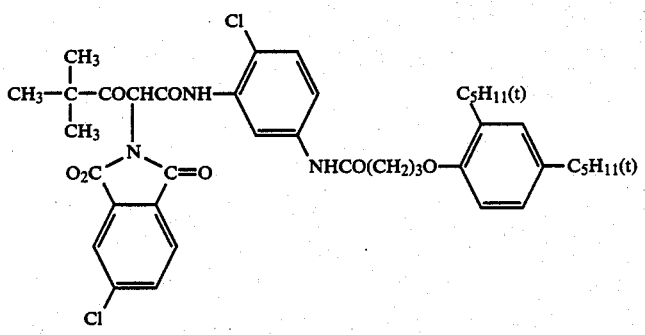
Y-28
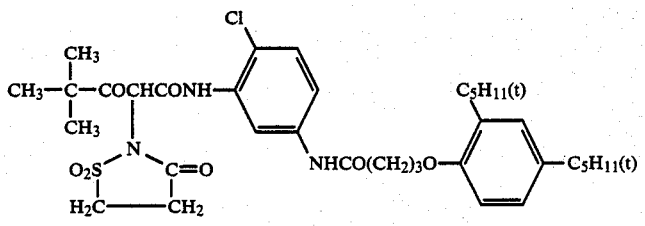

-continued
Y-29
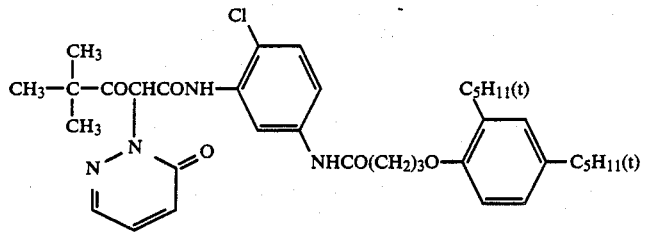
Y-30
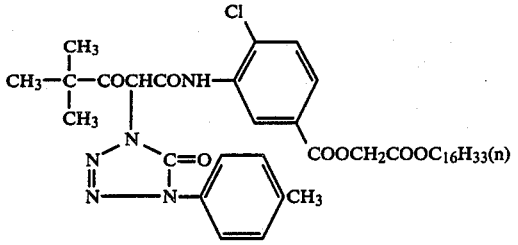
Y-31
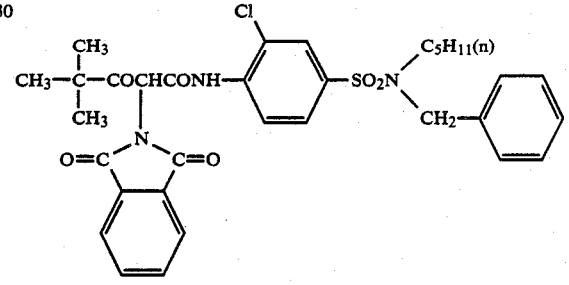
Y-32
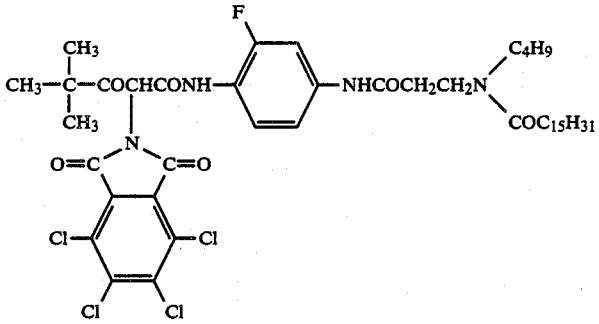
Y-33
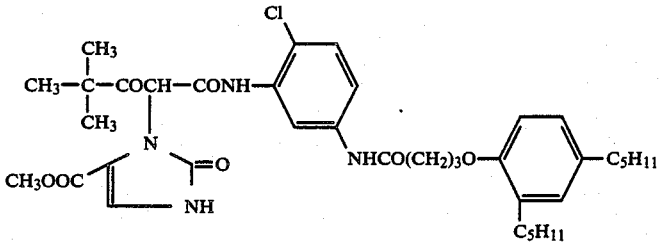
Y-34
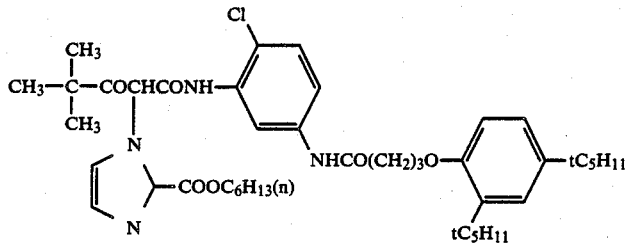
Y-35
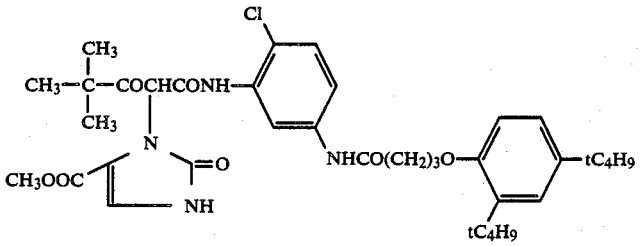

-continued

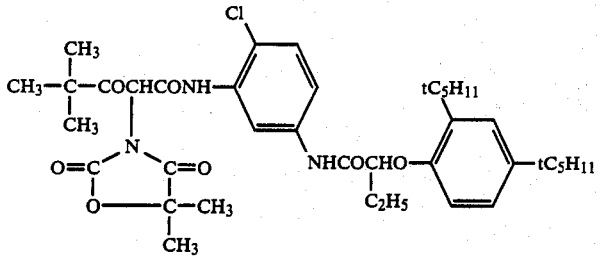

Y-36

The yellow couplers listed above may be prepared by any one of the methods shown in OLS Nos. 2,057,941 and 2,163,812, Japanese Unexamined Published Patent Application Nos. 26133/1972, 29432/1973, 65231/1975, 3631/1976, 50734/1976, 102636/1976, Japanese Patent Publication No. 33410/1976, Japanese Unexamined Published Patent Application Nos. 66835/1973, 94432/1973, 1229/1974, 10736/1974 and Japanese Patent Publication No. 25733/1977.

The yellow couplers of formula (I) may be used in combination with known yellow couplers.

The symbol $R_5$ in formula (II) representing the magenta coupler used in the present invention stands for a hydrogen atom, a halogen atom or an alkoxy group having a straight- or branched-chain alkyl moiety of 1 to 4 carbon atoms, with a halogen atom and an alkoxy group being preferred. Examples of the halogen atom represented by $R_5$ include chlorine, bromine and fluorine. Examples of the alkoxy group represented by $R_5$ include methoxy, ethoxy, propoxy, i-propoxy, butoxy, and tert-butoxy. Such alkoxy groups may have a substituent.

The symbol $R_6$ in formula (II) represents

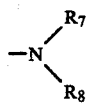

(wherein $R_7$ and $R_8$ may be the same or different and each represents a hydrogen atom or an acyl group, provided that when $R_7$ and $R_8$ are both an acyl group, they may be combined to form a 5-membered hetero ring together with a nitrogen atom), an alkyl- or arylsulfonamido group, an alkyl- or arylsulfamoyl group or an alkyl- or arylcarboxylic acid ester group.

It is to be noted that $R_6$, $R_7$ and $R_8$ may be unsubstituted or have substituents on the condition that they satisfy the inherent requirements such as those on the number of carbon atoms. Suitable substituents include straight- or branched-chain alkyl groups (e.g. methyl, ethyl, isopropyl, t-butyl, dodecyl and octyl), straight- or branched-chain alkenyl groups (e.g. allyl and octadecenyl), aryl groups (e.g. phenyl and naphthyl), residual hetero rings (e.g. thienyl, pyridyl and furyl), halogen atoms (e.g. chlorine, bromine and fluorine), oxy group, thio group, sulfone group, sulfinyl group, nitro group, amino group, cyano group, acyl group, acylamino group, hydroxy group, carbamoyl group, sulfonamido group, sulfamoyl group, ester group, carboxy group, sulfonic acid ester group and carbonyloxy group. Such substituents may be substituted by any one of the substituents listed above.

Examples of the halogen atom represented by $Y_1$ to $Y_3$ are chlorine and fluorine, with a chlorine atom being preferred. Examples of the alkyl group represented by $Y_1$ to $Y_3$ include $C_1$–$C_5$ alkyl groups such as methyl, ethyl, propyl, i-propyl, butyl and t-butyl; alkoxy groups such as methoxy and ethoxy; alkoxycarbonyl groups such as methoxycarbonyl and ethoxycarbonyl; aryloxy groups such as phenyloxy; as well as acylamino groups such as methylacylamino, ethylacylamino and butylacylamino groups.

The symbol $Z_3$ in formula (II) represents an atom or a group that leaves upon coupling reaction with the oxidation products of various known color developing agents. Examples of such leaving atoms or groups include halogen atoms and "split-off" groups which are well known in the art.

Typical example of the magenta coupler represented by formula (II) are listed below.

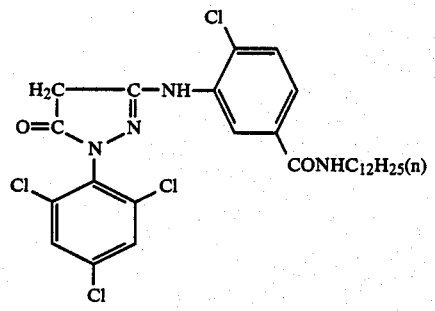

M-1

-continued
M-2
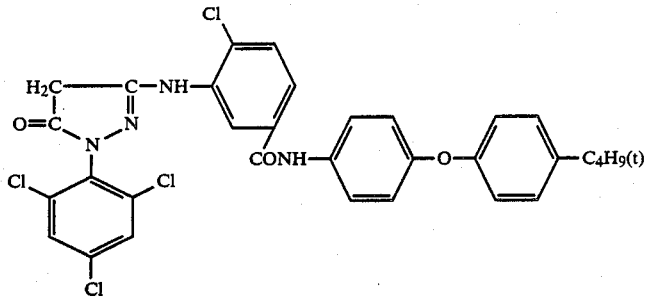
M-3
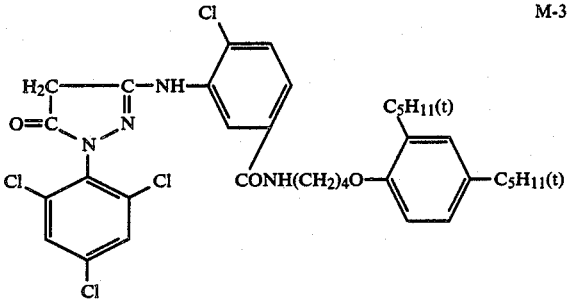
M-4
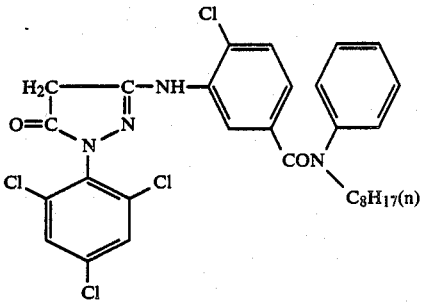
M-5
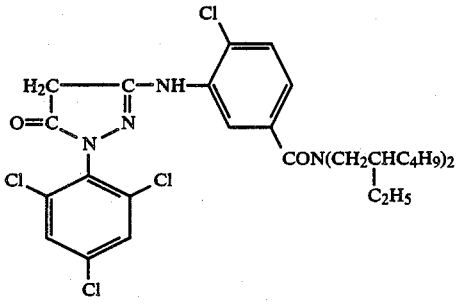
M-6
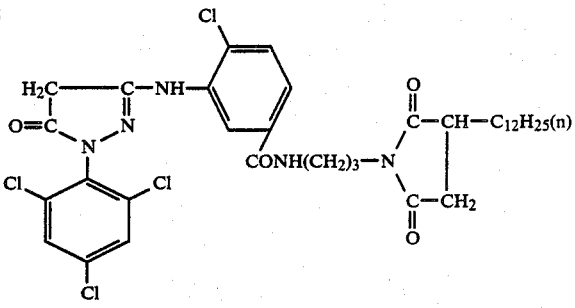
M-7
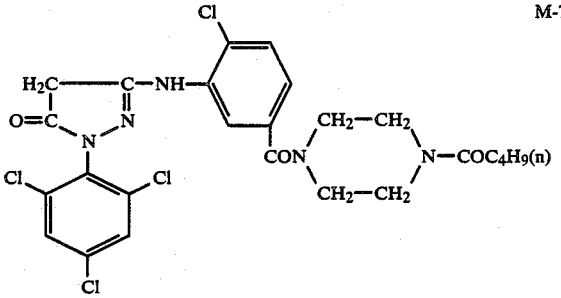
M-8
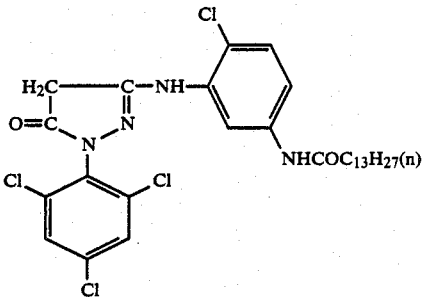
M-9
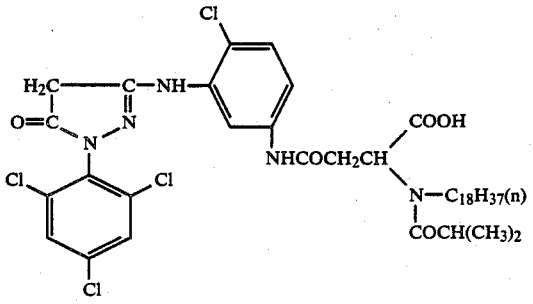

-continued
M-10
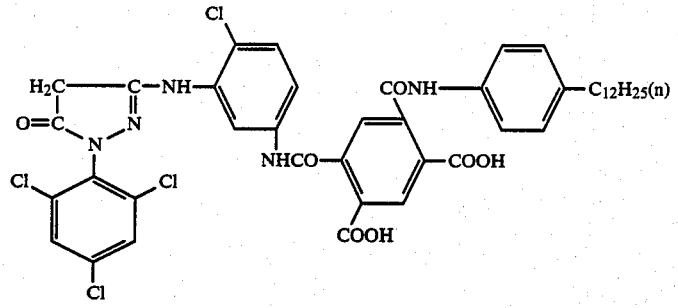
M-11
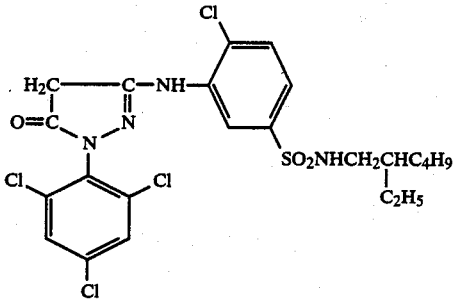
M-12
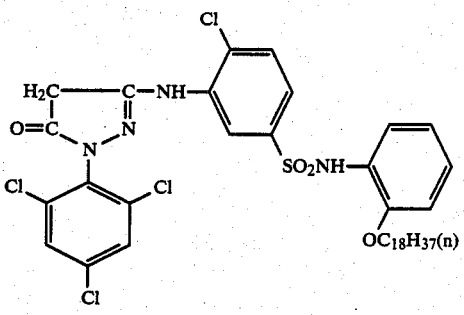
M-13
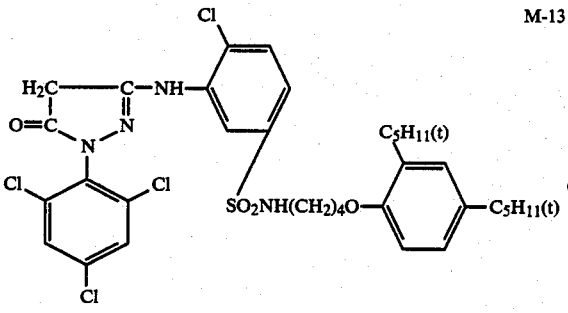
M-14
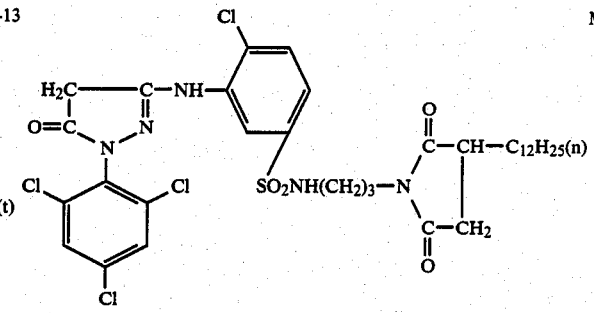
M-15
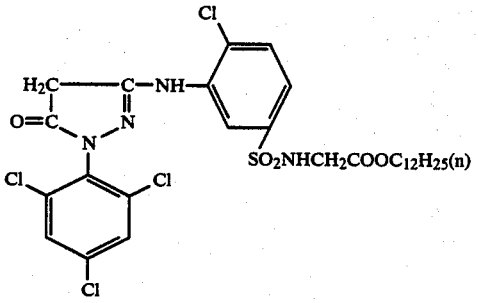
M-16
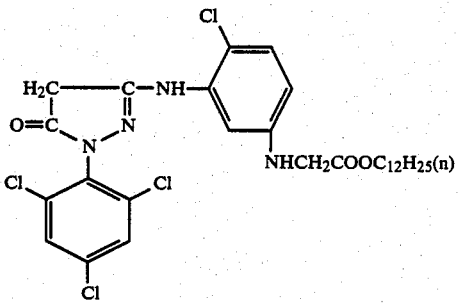
M-17
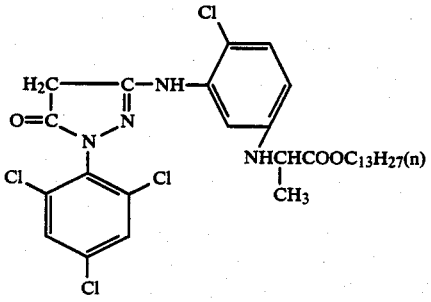
M-18
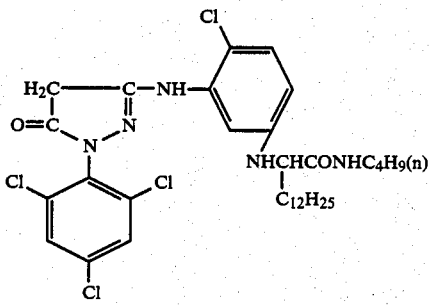

-continued
M-19
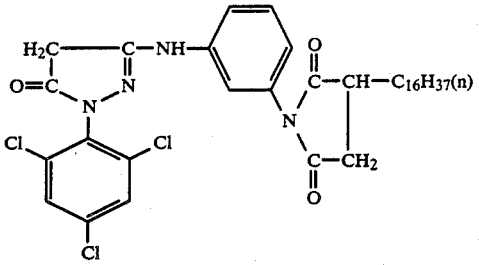
M-20
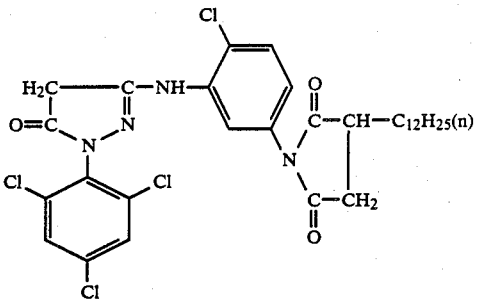
M-21
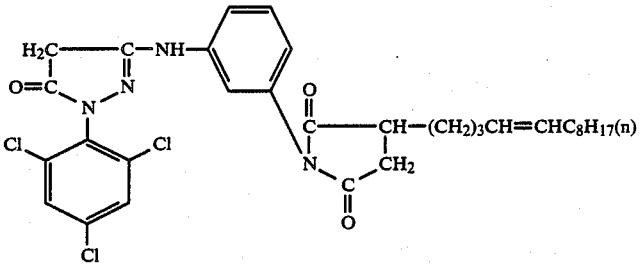
M-22
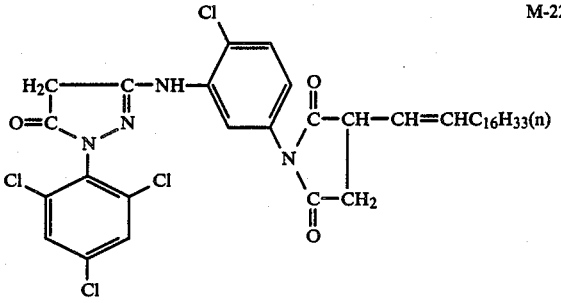
M-23
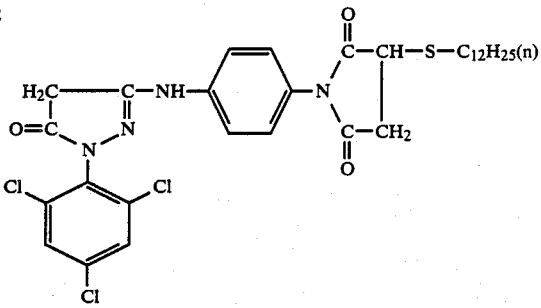
M-24
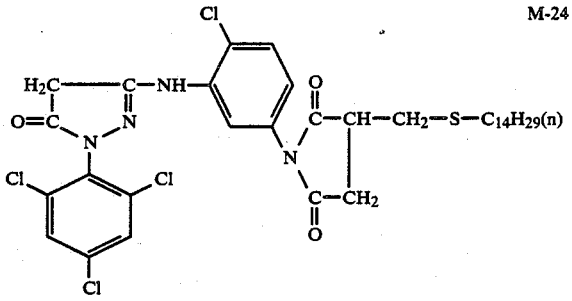
M-25
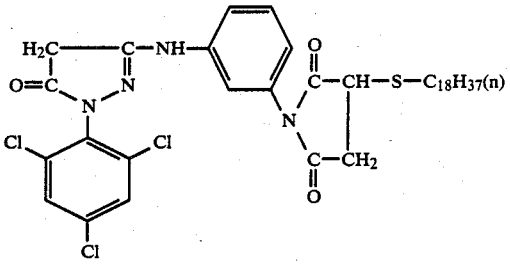
M-26
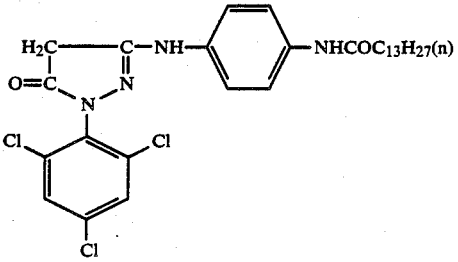
M-27
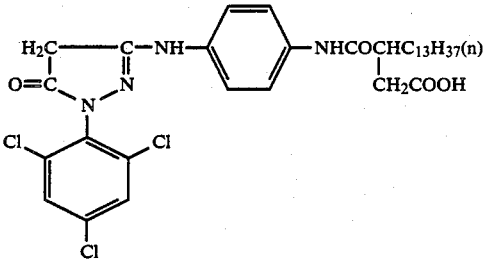

-continued
M-28
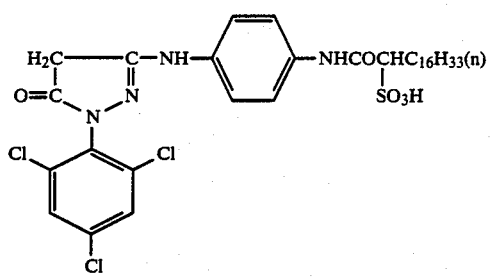
M-29
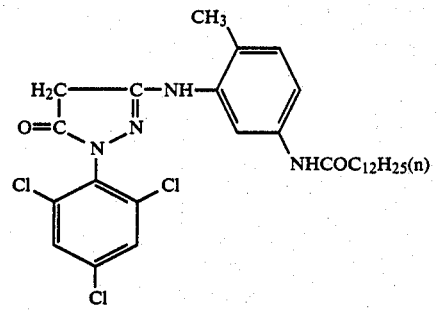
M-30
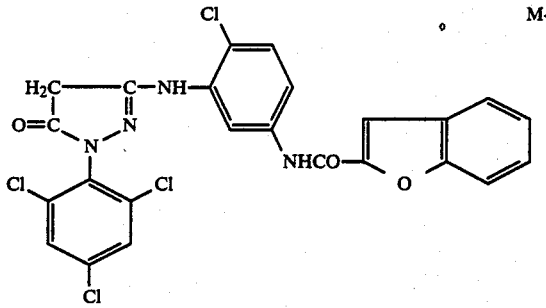
M-31
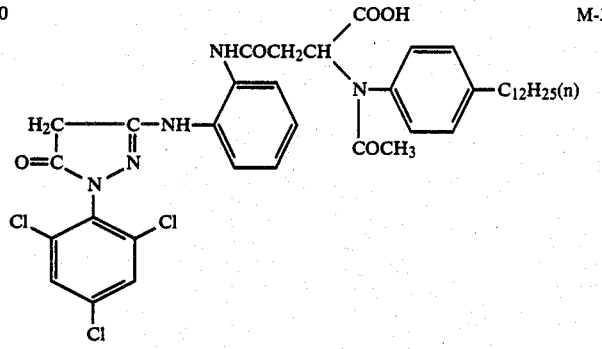
M-32
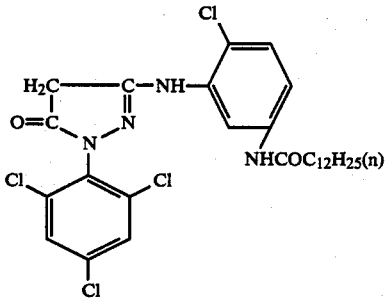
M-33
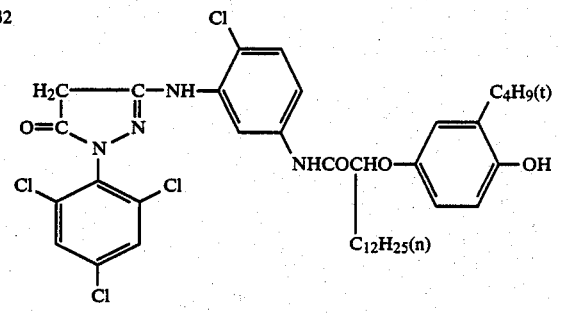
M-34
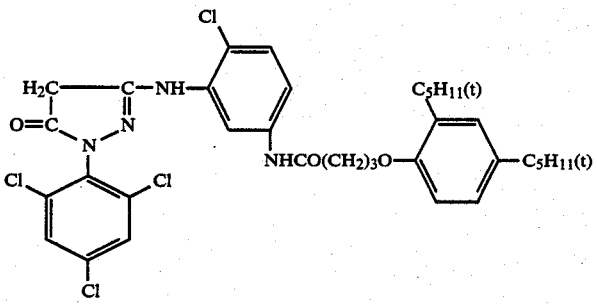
M-35
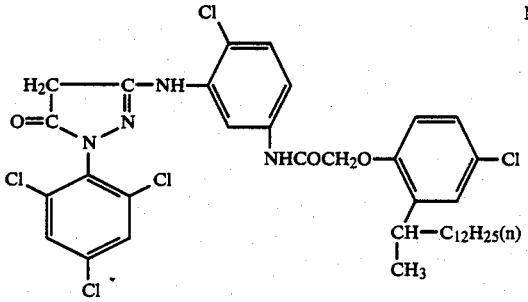
M-36
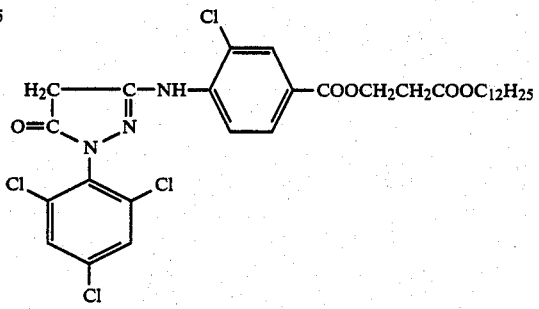

-continued
M-37
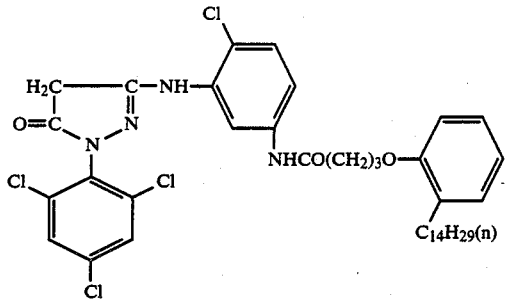
M-38
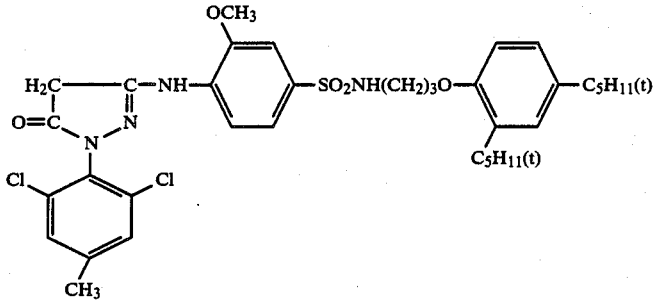
M-39
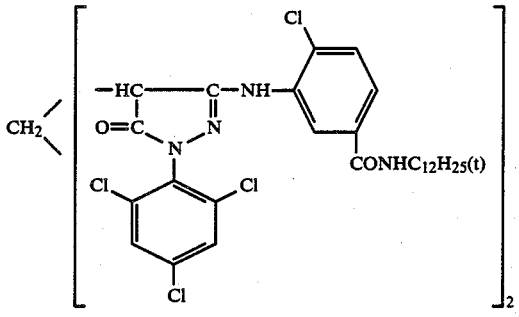
M-40
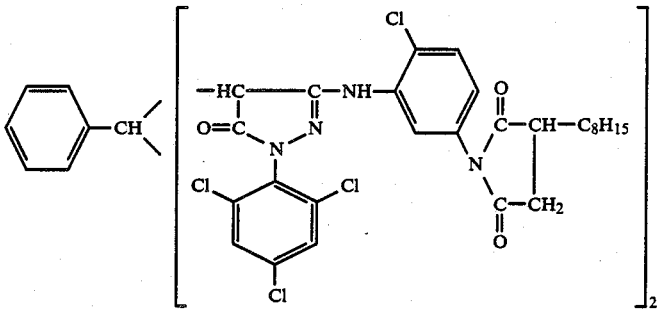
M-41
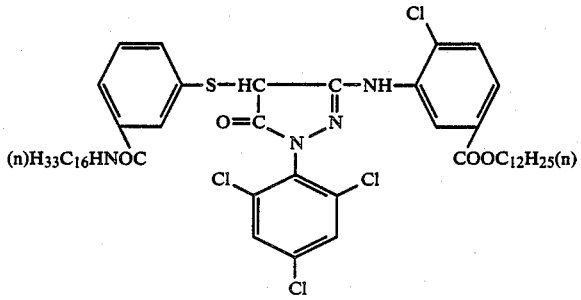

-continued

M-42

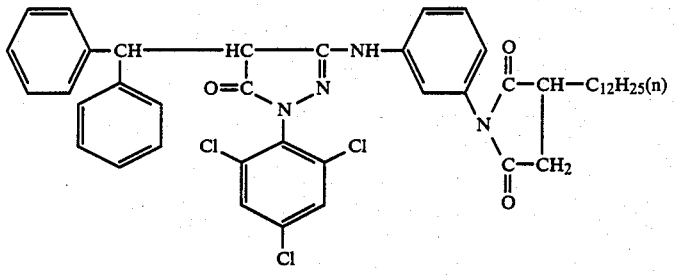

M-43

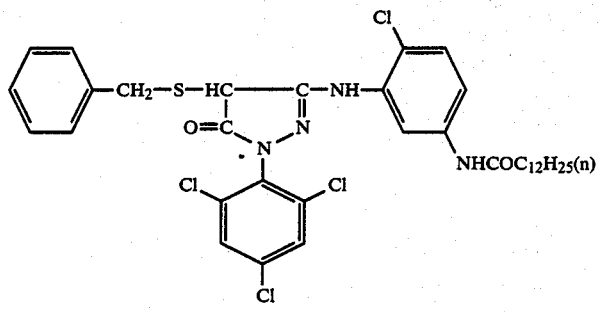

M-44

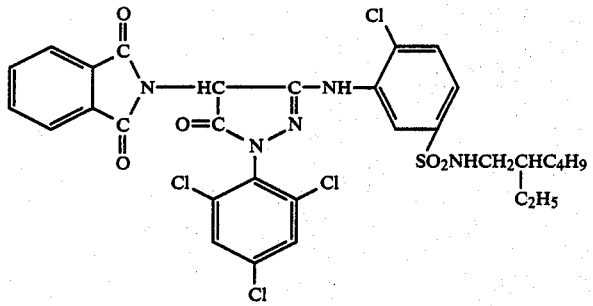

M-45

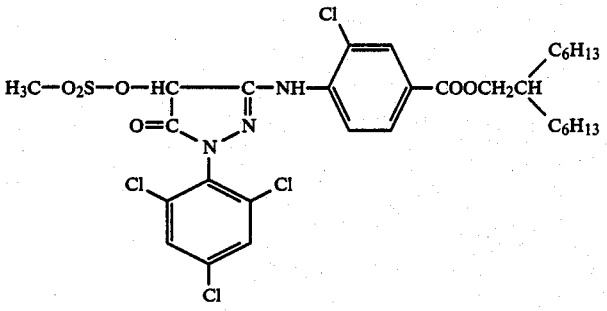

M-46

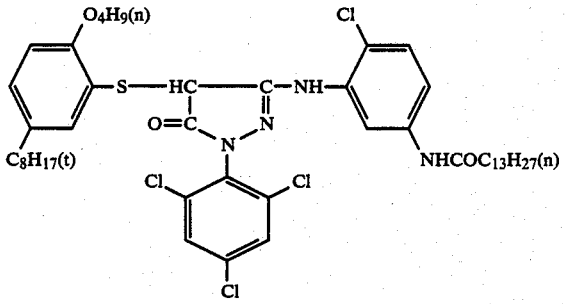

The magenta couplers listed above may be prepared by any one of the methods shown in U.S. Pat. No. 3,684,514, British Pat. No. 1,183,515, Japanese Patent Publication Nos. 6031/1965, 6035/1965, 15754/1969, 50757/1970, 19032/1971, Japanese Unexamined Published Patent Application Nos. 13041/1975, 129035/1978, 37646/1976 and 62454/1980. These couplers may be used in combination with known magenta couplers.

The symbol $R_9$ in formula (III) represents a straight- or branched-chain alkyl group having 2 to 4 carbon atoms, such as ethyl, propyl, i-propyl, butyl and t-butyl.

These alkyl groups may have substituents such as an acylamino group (e.g. acetylamino), and an alkoxy group (e.g. methoxy). An unsubstituted alkyl group is preferred.

The symbol $R_{10}$ in formula (III) represents a ballast group which is an organic group having such a size and shape that provides a coupler molecule with sufficient bulkiness to substantially prevent its diffusion from the layer where said coupler is incorporated to another layer. Typical ballast groups are alkyl and aryl groups having a total of 8 to 32 carbon atoms. Such alkyl and aryl groups may have substituents; substituents for aryl groups include alkyl, aryl, alkoxy, aryloxy, carboxy, acyl, ester, hydroxy, cyano, nitro, carbamoyl, carbonamido, alkylthio, arylthio, sulfonyl, sulfonamido, sulfamoyl and halogen, and such substituents excepting alkyl may also be used as substituents for alkyl groups.

Preferred ballast groups are represented by the following formula:

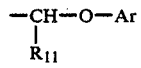

wherein $R_{11}$ is a hydrogen atom or an alkyl group having 1 to 12 carbon atoms; Ar is an aryl group such as phenyl, which may be substituted by, for example, an alkyl, hydroxy, or alkylsulfonamido, with a branched-cahain alkyl group such as t-butyl being preferred.

Typical examples of the cyan coupler represented by formula (III) are listed below, to which the scope of the present invention is by no means limited.

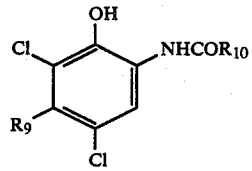

(III)

Exemplary compounds

| Coupler No. | $R_9$ | $R_{10}$ |
|---|---|---|
| 1 | $-C_2H_5$ | 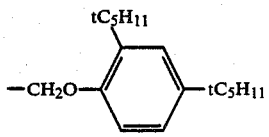 |
| 2 | $-C_2H_5$ | 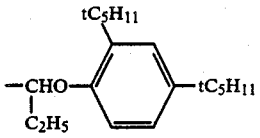 |
| 3 | 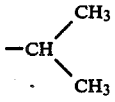 | 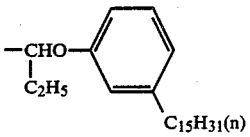 |
| 5 | $-C_2H_5$ | 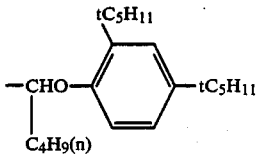 |
| 6 | $-C_4H_9$ | 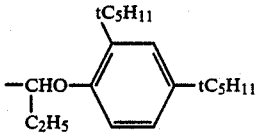 |
| 7 | $-C_2H_5$ | 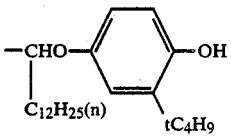 |

-continued
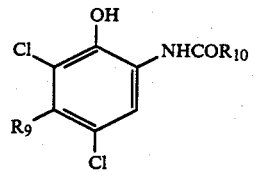
(III)
Exemplary compounds
| Coupler No. | $R_9$ | $R_{10}$ |
|---|---|---|
| 8 | $-C_2H_5$ | 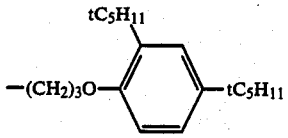 |
| 9 | $-C_2H_5$ | 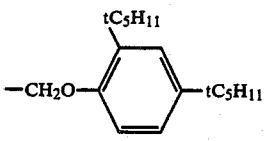 |
| 10 | $-C_4H_9$ | 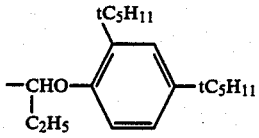 |
| 11 | $-C_2H_5$ | 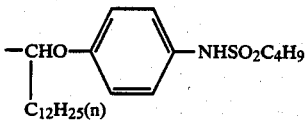 |
| 12 | $-C_2H_5$ | 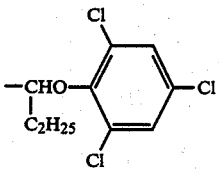 |
| 13 | 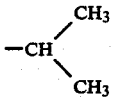 | $-C_{18}H_{37}(n)$ |
| 14 | $-C_2H_5$ | 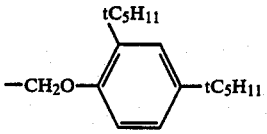 |
| 15 | $-C_2H_5$ | 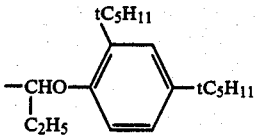 |
| 16 | $-C_2H_5$ | 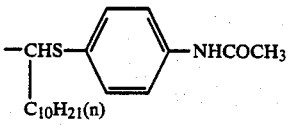 |

-continued (III)

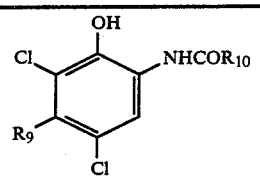

Exemplary compounds

| Coupler No. | $R_9$ | $R_{10}$ |
|---|---|---|
| 17 | $-C_3H_7$ | 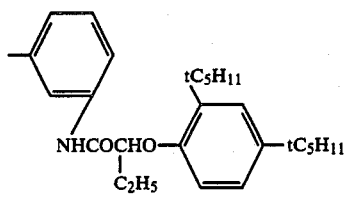 |
| 18 | $-C_3H_7$ | 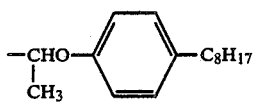 |
| 19 | $-C_2H_4NHCOCH_3$ | 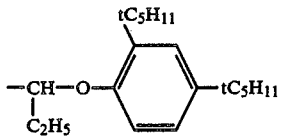 |
| 20 | $-C_3H_6OCH_3$ | 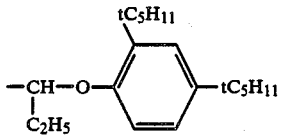 |
| 21 | $-C_2H_5$ | 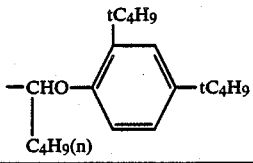 |

Exemplary compound No. 1 as a cyan coupler according to the present invention can be produced by the following method, which may be properly modified and applied to the preparation of other exemplary compounds.

(1)-a: Preparation of 2-nitro-4,6-dichloro-5-ethylphenol

A mixture of 2-nitro-5-ethylphenol (33 g), iodine (0.6 g) and ferric chloride (1.5 g) was dissolved in glacial acetic acid (150 ml). To the resulting solution, 75 ml of sulfuryl chloride was added dropwise at 40° C. over a period of 3 hrs. The precipitate formed during the dropwise addition of sulfuryl chloride was dissolved by refluxing which was effected after completion of the addition. The refluxing was continued for about 2 hrs. The reaction solution was poured into water and the resulting crystal was purified by recrystallization from methanol. The crystal was identified as compound (1)-a by NMR and elemental analyses.

(1)-b: Preparation of 2-amino-4,6-dichloro-5-ethylphenol

Compound (1)-a (21.2 g) was dissolved in 300 ml of alcohol. A catalytic amount of Raney nickel was added to the solution and hydrogen was bubbled into the solution at atmospheric pressure until the absorption of hydrogen ceased. After completion of the reaction, the Raney nickel was removed and the alcohol was distilled off under vacuum. The residual (1)-b compound was subjected to the subsequent acylation without purification.

(1)-c: Preparation of 2-[(2,4-di-tert-amylphenoxy)acetamido]-4,6-dichloro-5-ethylphenol The crude amino compound (1)-b (18.5 g) was dissolved in a liquid mixture of glacial acetic acid (500 ml) and sodium acetate (16.7 g). To the resulting solution was added dropwise a solution of 2,4-di-tert-aminophenoxyacetic acid chloride (28.0 g) in acetic acid (50 ml) at room temperature over a period of 30 minutes. Following stirring for an additional 30 minutes, the reaction solution was poured into iced water. The resulting crystal was recovered by filtration and dried. Two recrystallizations with acetonitrile gave the end compound. It was identified as (1)-c by elemental and NMR analyses.

Elemental analysis for $C_{26}H_{35}NO_3Cl_2$

| | C | H | N | Cl (%) |
|---|---|---|---|---|
| Calculated: | 65.00 | 7.34 | 2.92 | 14.76 |
| Found: | 64.91 | 7.36 | 2.99 | 14.50 |

The cyan couplers of formula (III) according to the present invention may be used in combination with known cyan couplers.

Any of the cyan couplers represented by said formula (III) that is used in the silver halide photographic material of the present invention may further be combined with at least one of the compounds represented by the following formula [IV] or [V], thereby allowing the material to exhibit dye images of better quality particularly when in prolonged storage:

[IV]

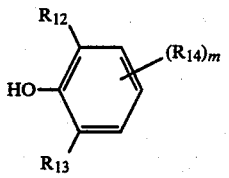

wherein $R_{12}$ and $R_{13}$ are each an alkyl group; $R_{14}$ is a hydrogen atom, an alkyl group, $—NR'_{13}R''_{13}$, $—SR'_{13}$ or $—COOR''_{13}$ (wherein $R'_{13}$ is a monovalent organic group, and $R''_{13}$ is a hydrogen atom or a monovalent organic group); and m is an integer of 0 to 3.

[V]

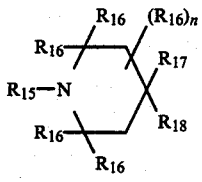

wherein $R_{15}$ is a hydrogen atom, a hydroxyl group, an oxyradical group (—Ȯ), $—SOR'_{15}$, $—SO_2R''_{15}$ (wherein $R'_{15}$ and $R''_{15}$ are each a monovalent organic group), an alkyl group, an alkenyl group, an alkynyl group or $—COR'''_{15}$ (wherein $R'''_{15}$ is a hydrogen atom or a monovalent organic group); $R_{16}$ is an alkyl group; $R_{17}$ and $R_{18}$ are each a hydrogen atom or —OCOR' (wherein R' is a monovalent organic group), or $R_{17}$ and $R_{18}$ may be joined to form a heterocyclic group; and n is an integer of 0 to 4.

The compounds represented by formula [IV] in the present invention are preferably those represented by the following formula [VI]:

[VI]

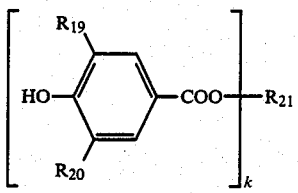

wherein $R_{19}$ and $R_{20}$ are each a straight- or branched-chain alkyl group having 3 to 8 carbon atoms, particularly a t-butyl group or a t-pentyl group; $R_{21}$ is an organic group having a valence of k; and k is an integer of 1 to 6.

The organic group having a valence of k represented by $R_{21}$ includes, for example, an alkyl group such as methyl, ethyl, propyl, butyl, pentyl, octyl, hexadecyl, methoxyethyl, chloromethyl, 1,2-dibromoethyl, 2-chloroethyl, benzyl and phenethyl; an alkenyl group such as allyl, propenyl and butenyl; a polyvalent unsaturated hydrocarbon group such as ethylene, trimethylene, propylene, hexamethylene and 2-chlorotrimethylene; an unsaturated hydrocarbon group such as glycelyl, diglycelyl, pentaerythrityl and dipentaerythrityl; an aliphatic hydrocarbon group such as cyclopropyl, cyclohexyl and cyclohexenyl; an aryl group such as phenyl, p-octylphenyl, 2,4-dimethylphenyl, 2,4-di-t-butylphenyl, 2,4-di-t-pentylphenyl, p-chlorophenyl, 2,4-dibromophenyl, 1,3,5-substituted benzene and naphthyl; and an arylene group such as 1,2-, 1,3- or 1,4-phenylene, 3,5-dimethyl-1,4-phenylene, 2-t-butyl-1,4-phenylene, 2-chloro-1,4-phenylene and naphthalene.

$R_{21}$ further includes an organic group having a valence of k such that any of said groups is bonded through —O—, —S— or $—SO_2—$.

$R_{21}$ is more preferably 2,4-di-t-butylphenyl, 2,4-di-t-pentylphenyl, p-octylphenyl, p-dodecylphenyl, 3,5-di-t-butyl-4-hydroxylphenyl or 3,5-di-t-pentyl-4-hydroxylphenyl.

Also, k is preferably an integer of 1 to 4.

Typical compounds represented by formula [IV] are listed below.

(IV-1)

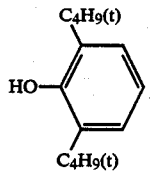

(IV-2)

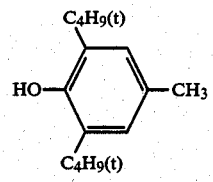

(IV-3)

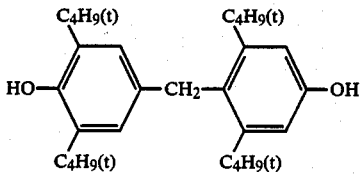

(IV-4)

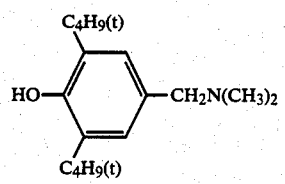

-continued
(IV-5)
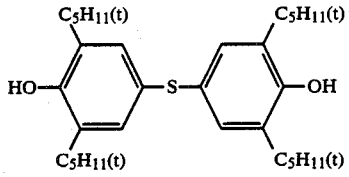
(IV-6)
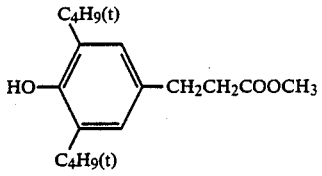
(IV-7)
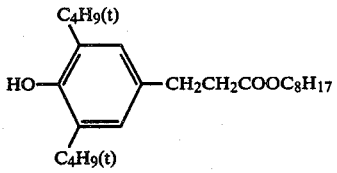
(IV-8)
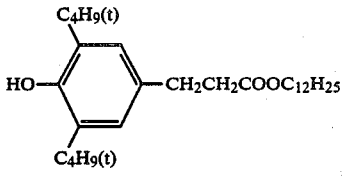
(IV-9)
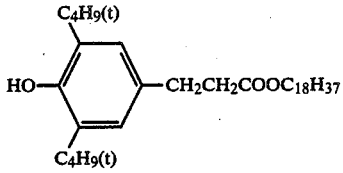
(IV-10)
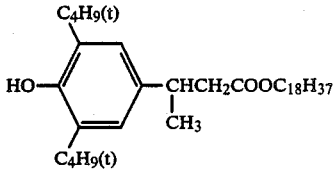
(IV-11)
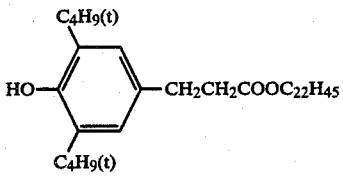
(IV-12)
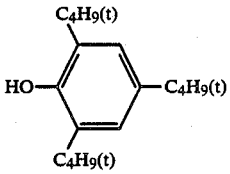
(IV-13)
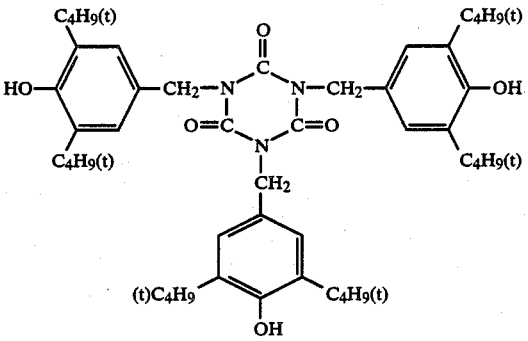
(IV-14)
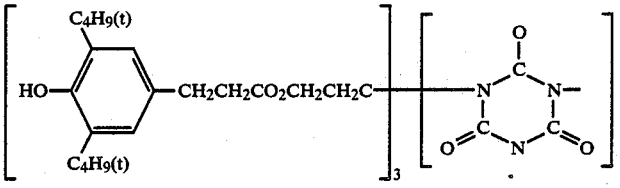
(IV-15)
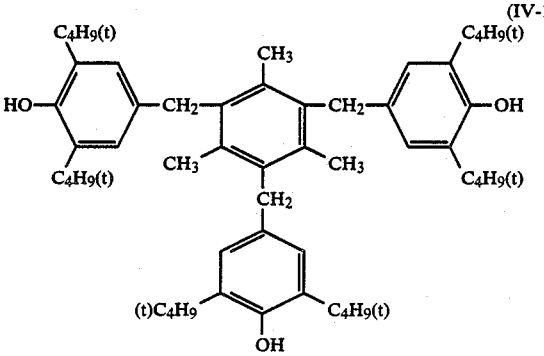
(IV-16)
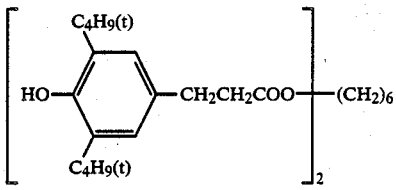

-continued
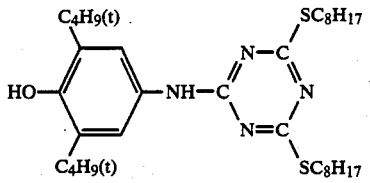
(IV-17)
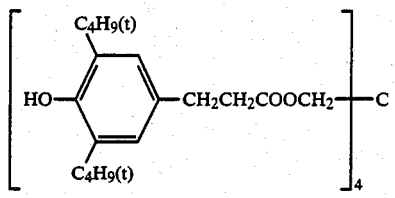
(IV-18)
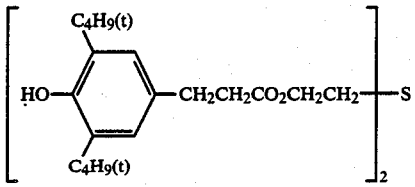
(IV-19)
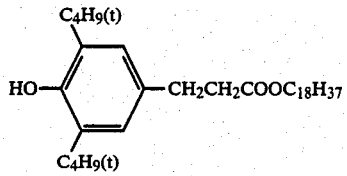
(IV-20)
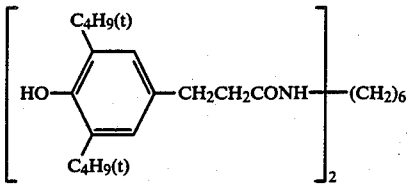
(IV-21)
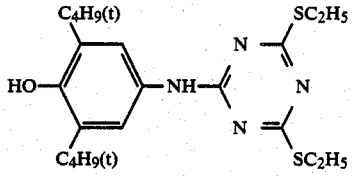
(IV-22)
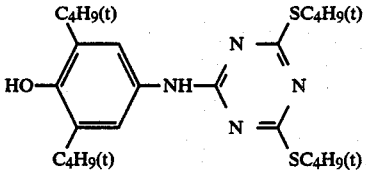
(IV-23)
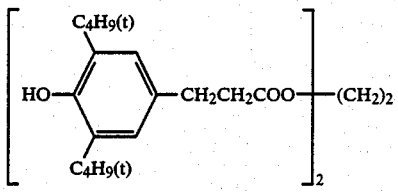
(IV-24)
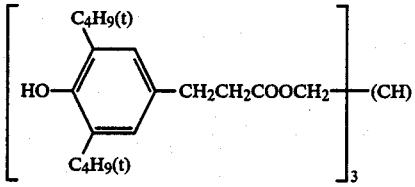
(IV-25)
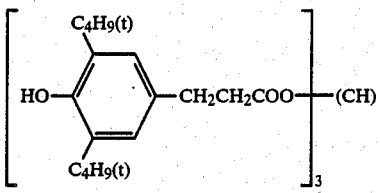
(IV-26)
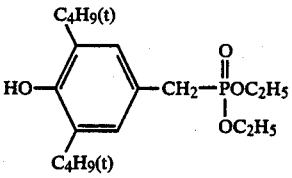
(IV-27)
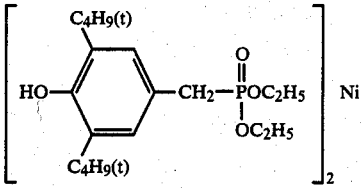
(IV-28)
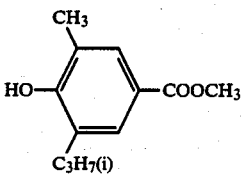
(IV-29)
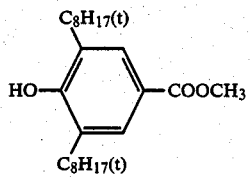
(IV-30)
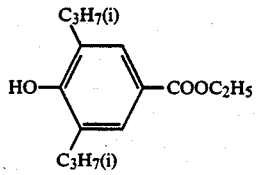
(IV-31)
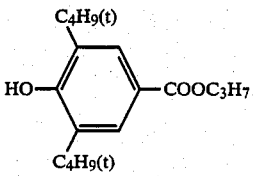
(IV-32)

-continued
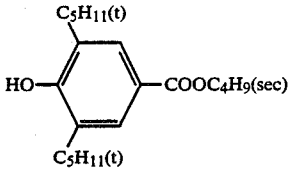
(IV-33)
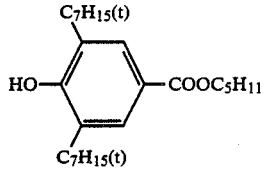
(IV-34)
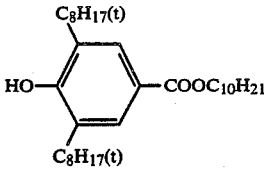
(IV-35)
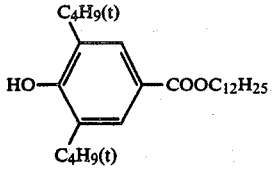
(IV-36)
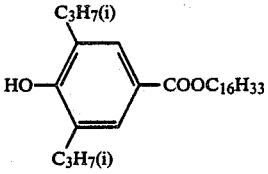
(IV-37)
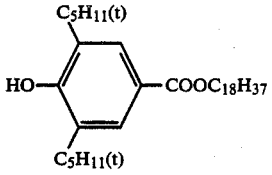
(IV-38)
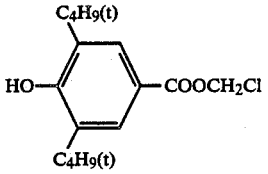
(IV-39)
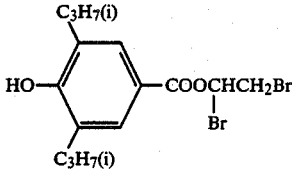
(IV-40)
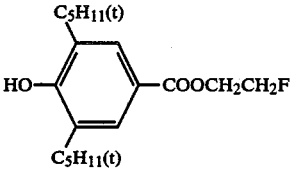
(IV-41)
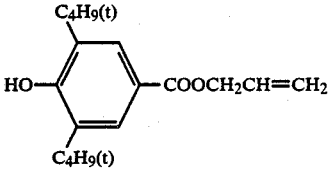
(IV-42)
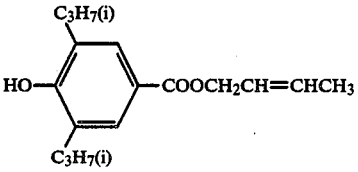
(IV-43)
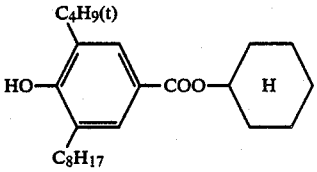
(IV-44)
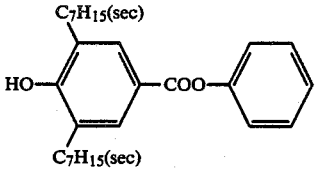
(IV-45)
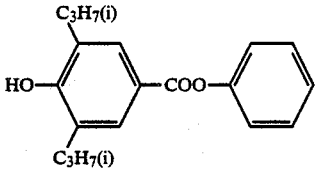
(IV-46)
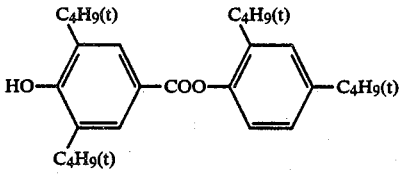
(IV-47)
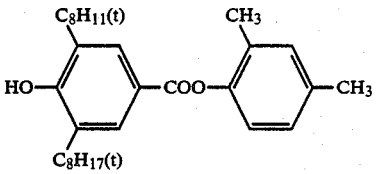
(IV-48)
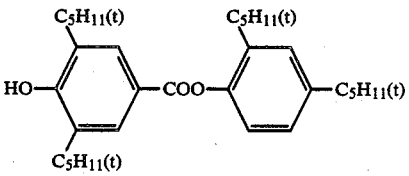
(IV-49)
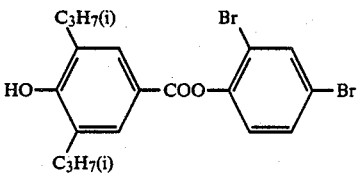
(IV-50)

-continued
(IV-51)
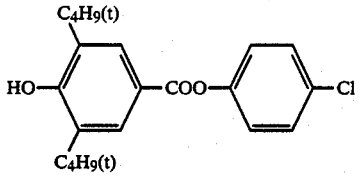
(IV-52)
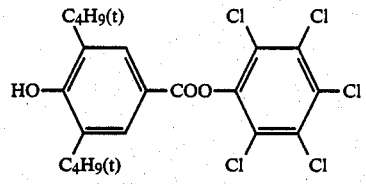
(IV-53)
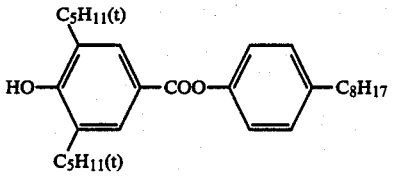
(IV-54)
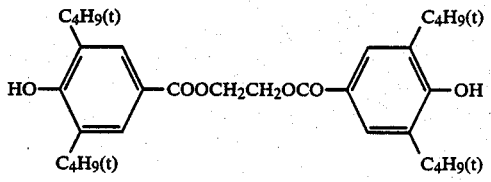
(IV-55)
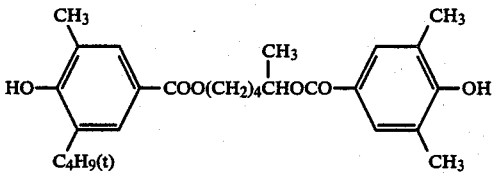
(IV-56)
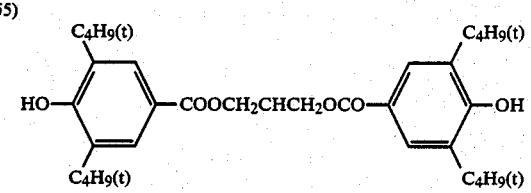
(IV-57)
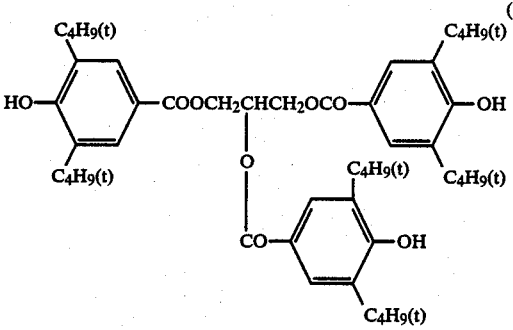
(IV-58)
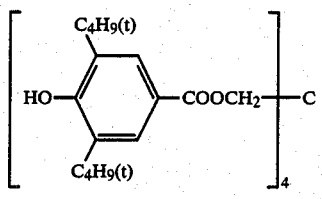
(IV-59)
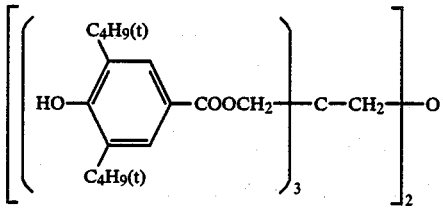
(IV-60)
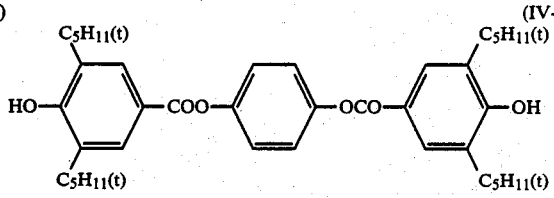
(IV-61)
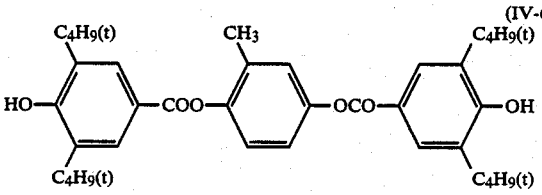
(IV-62)
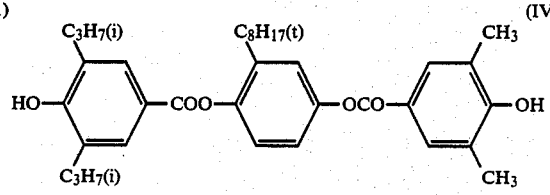

-continued
(IV-63)
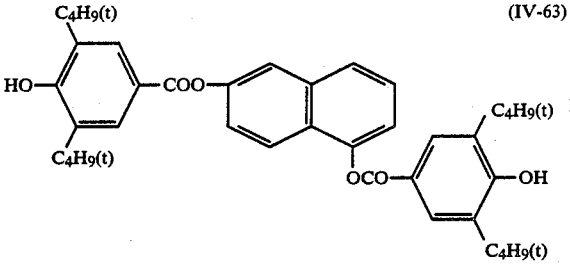
(IV-64)
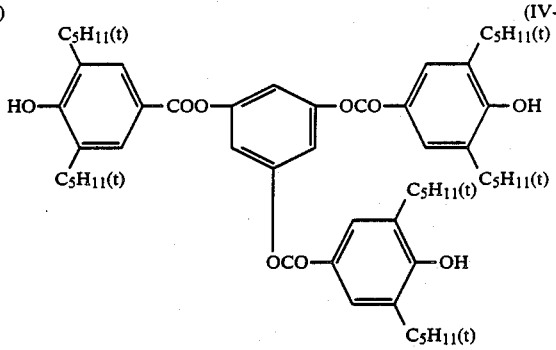
(IV-65)
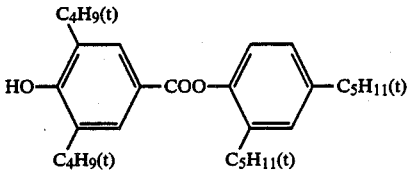
(IV-66)
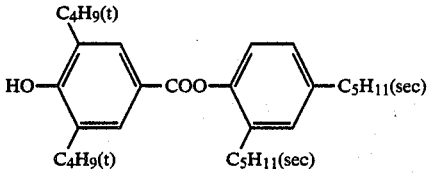
(IV-67)
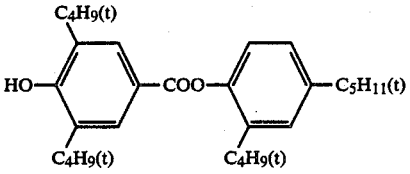
(IV-68)
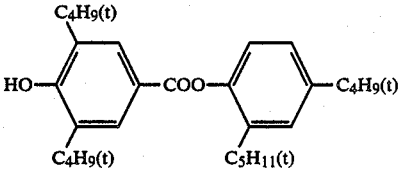
(IV-69)
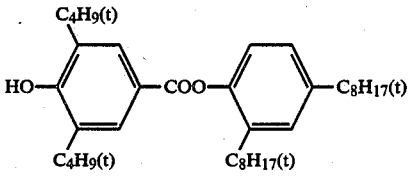
(IV-70)
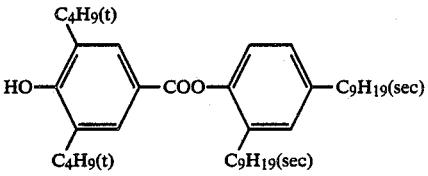
(IV-71)
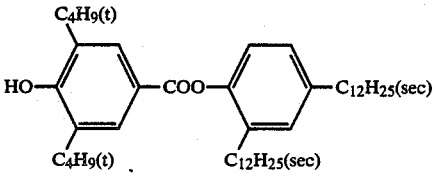
(IV-72)
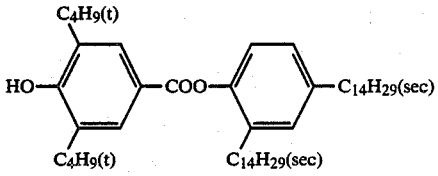
(IV-73)
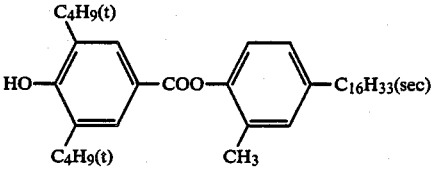
(IV-74)
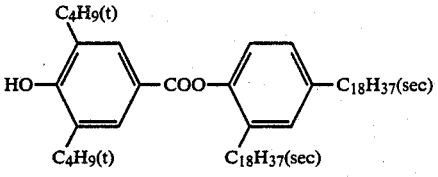
(IV-75)
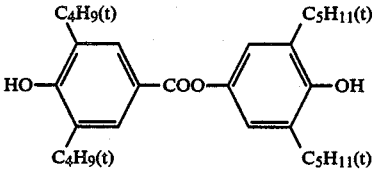
(IV-76)
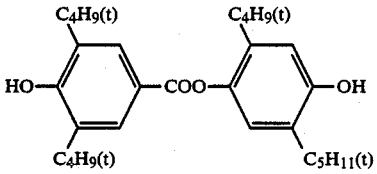
(IV-77)
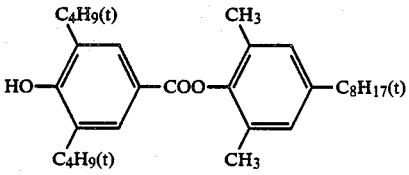
(IV-78)
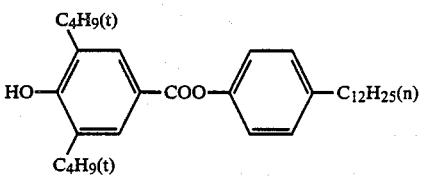

-continued (IV-79)

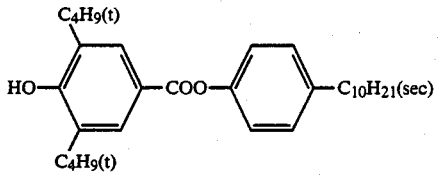

(IV-80)

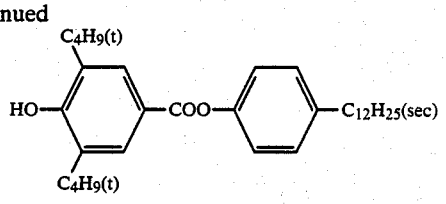

(IV-81)

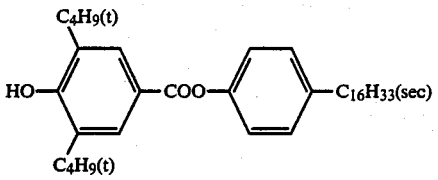

(IV-82)

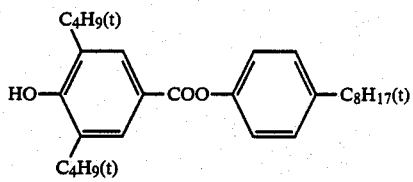

(IV-83)

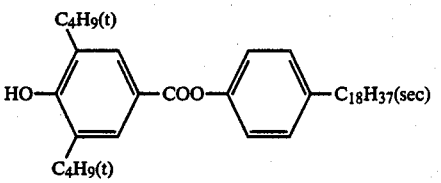

(IV-84)

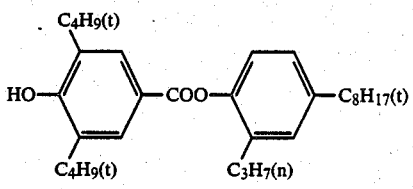

(IV-85)

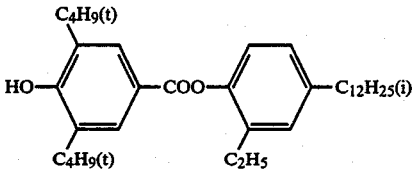

(IV-86)

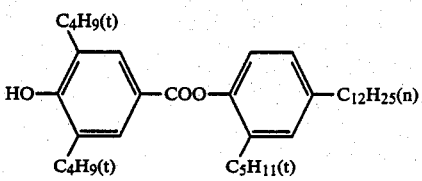

(IV-87)

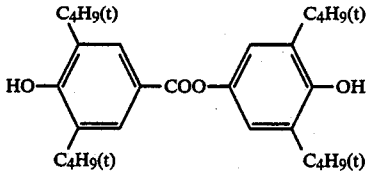

(IV-88)

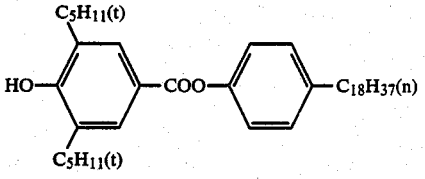

(IV-89)

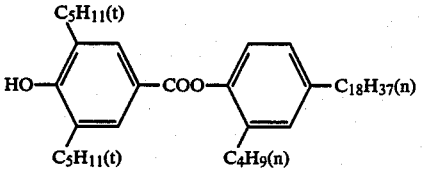

(IV-90)

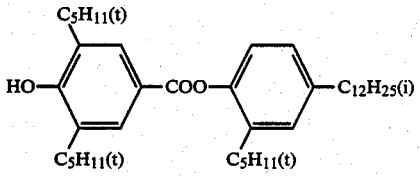

The alkyl group represented by $R_{14}$ in formula [V] in the present invention preferably has 1 to 12 carbon atoms, and the alkenyl group 2 to 4 carbon atoms. The monovalent organic group represented by each of $R'_{14}$ and $R'''_{14}$ includes, for example, alkyl, alkenyl, alkynyl and aryl groups. A preferred group represented by $R_{14}$ is hydrogen, alkyl (e.g. methyl, ethyl, propyl, butyl, chloromethyl, hydroxymethyl and benzyl), alkenyl (e.g. vinyl, allyl and isopropenyl), alkynyl (e.g. ethynyl and propynyl) or —$COR'''_{14}$ wherein $R'''_{14}$ is, for example, alkyl (e.g. methyl, ethyl, propyl, butyl and benzyl), alkenyl (e.g. vinyl, allyl and isopropenyl), alkynyl (e.g. ethynyl and propynyl) or aryl (e.g. phenyl and tolyl).

The alkyl group represented by $R_{15}$ is preferably a straight- or branched-chain alkyl group having 1 to 5 carbon atoms, particularly preferably a methyl group.

In $R_{17}$ and $R_{18}$, the monovalent organic group represented by R' includes, for example, an alkyl group (e.g. methyl, ethyl, propyl, butyl, pentyl, octyl, dodecyl and octadecyl), an alkenyl group (e.g. vinyl), an alkynyl group (e.g. ethynyl), an aryl group (e.g. phenyl and naphthyl), an alkylamino group (e.g. ethylamino) and an arylamino group (e.g. anilino). The heterocyclic group formed jointly by $R_{17}$ and $R_{18}$ includes, for example,

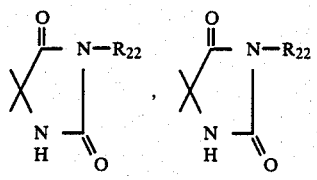

and the like (wherein $R_{22}$ is a hydrogen atom, an alkyl group, a cycloalkyl group or a phenyl group).

The compounds represented by formula [V] in the present invention preferably include those represented by the following formula [VII]:

[VII]

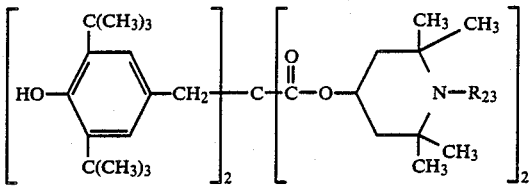

wherein $R_{23}$ is an alkyl group (e.g. methyl, ethyl, propyl, butyl, pentyl and benzyl), an alkenyl group (e.g. vinyl, allyl and isopropenyl), an alkynyl group (e.g. ethynyl and propynyl) and an acyl group (e.g. formyl, acetyl, propionyl, butyryl, acryloyl, propyoloyl, methacryloyl and chlotonoyl).

More preferred groups of $R_{23}$ include methyl, ethyl, vinyl, allyl, propynyl, benzyl, acetyl, propionyl, acryloyl, methacryloyl and chlotonoyl.

Typical compounds represented by formula [V] are listed below.

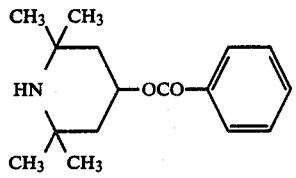

(V-1)

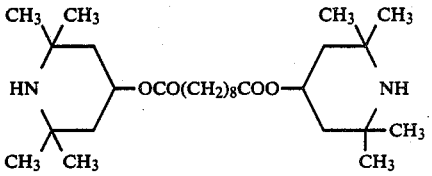

(V-2)

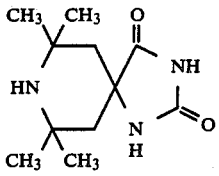

(V-3)

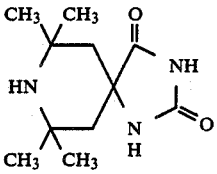

(V-4)

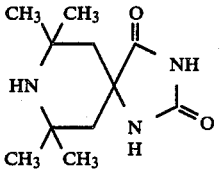

(V-5)

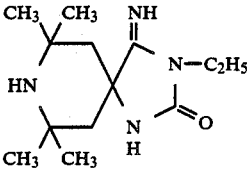

(V-6)

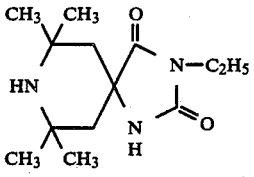

(V-7)

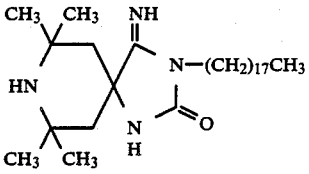

(V-8)

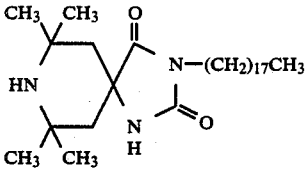

(V-9)

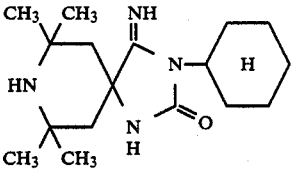

(V-10)

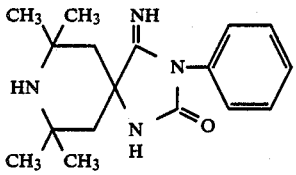

(V-11)

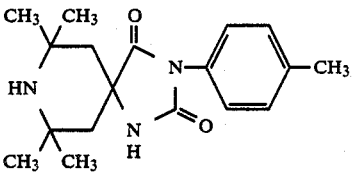

(V-12)

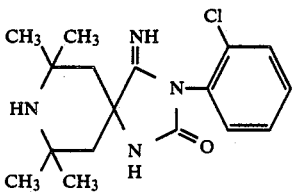

(V-13)

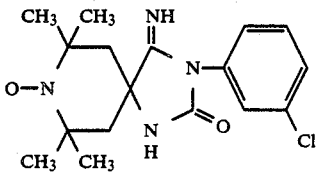

(V-14)

-continued
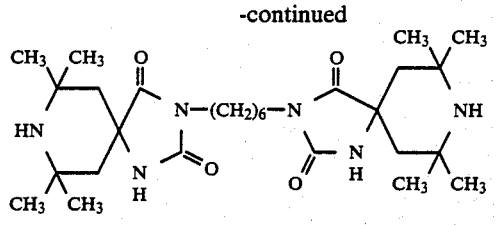
(V-15)
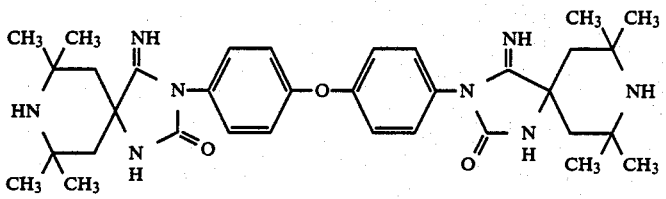
(V-16)
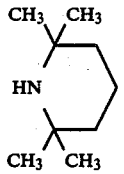
(V-17)
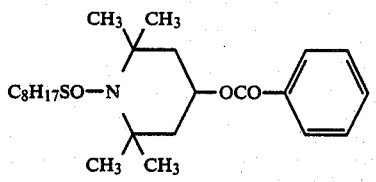
(V-18)
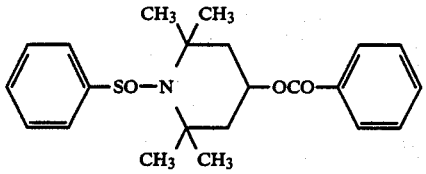
(V-19)
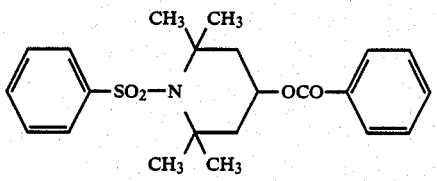
(V-20)
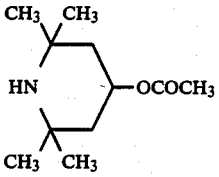
(V-21)
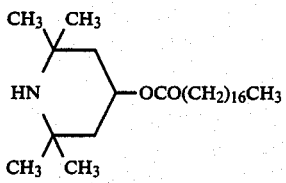
(V-22)
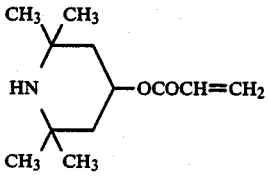
(V-23)
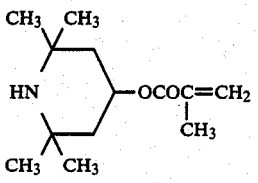
(V-24)
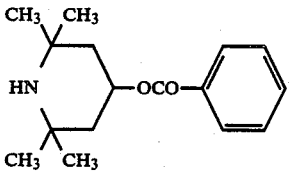
(V-25)
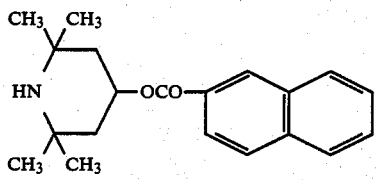
(V-26)
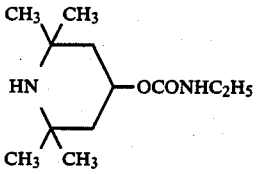
(V-27)
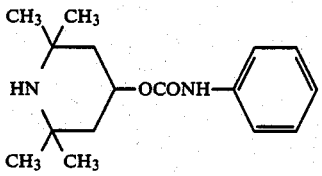
(V-28)
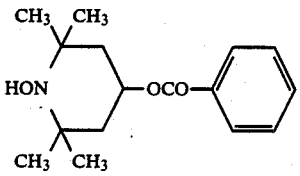
(V-29)
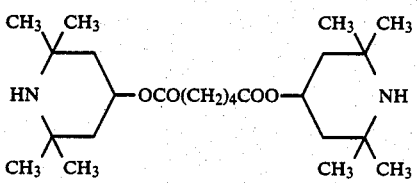
(V-30)

-continued
(V-31)
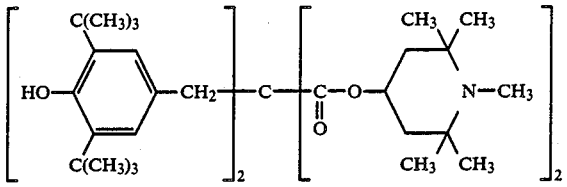
(V-32)
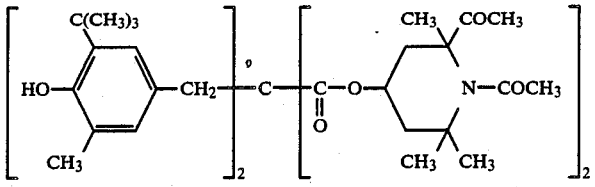
(V-33)
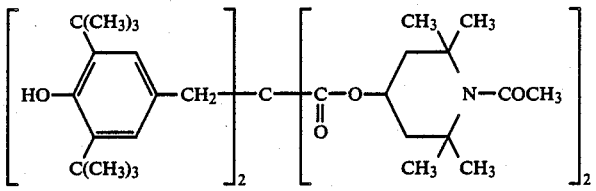
(V-34)
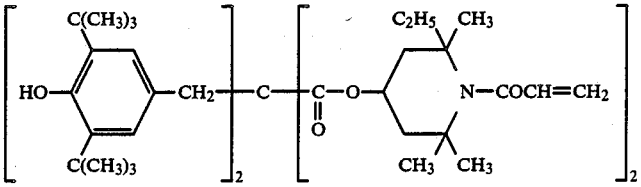
(V-35)
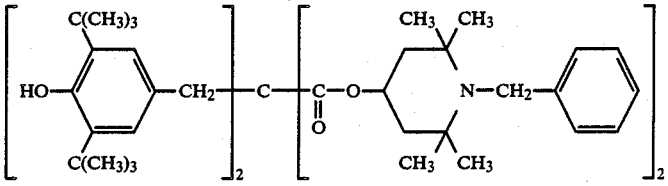
(V-36)
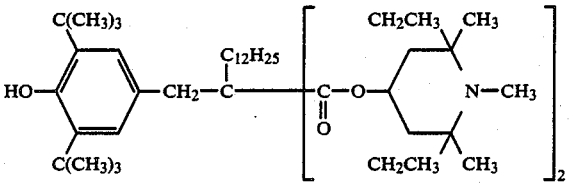
(V-37)
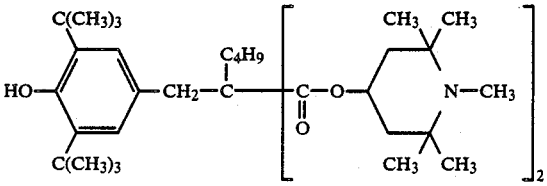

-continued
(V-38)
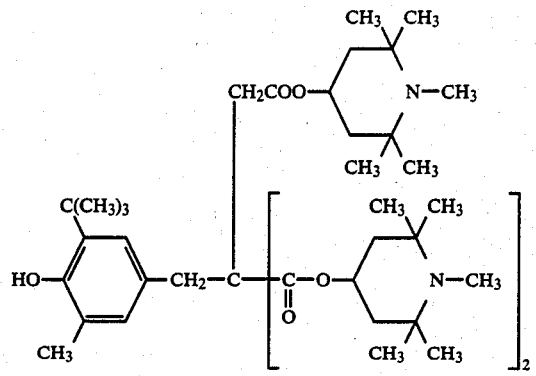
(V-39)
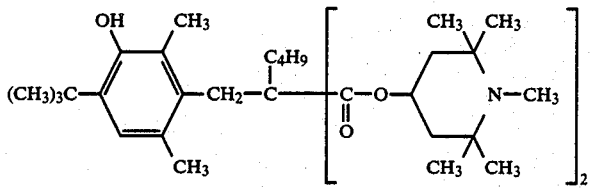
(V-40)
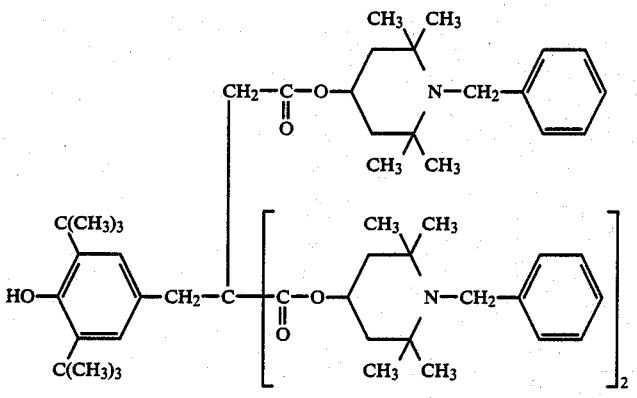
(V-41)
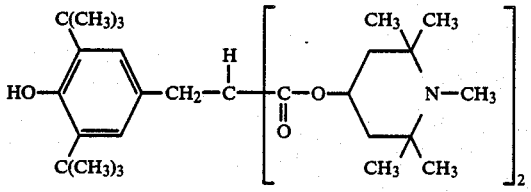
(V-42)
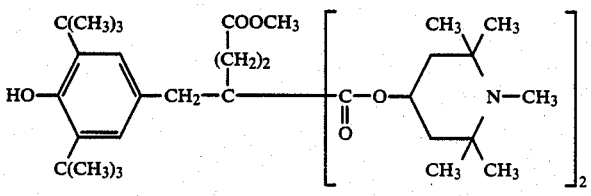

-continued
(V-43)
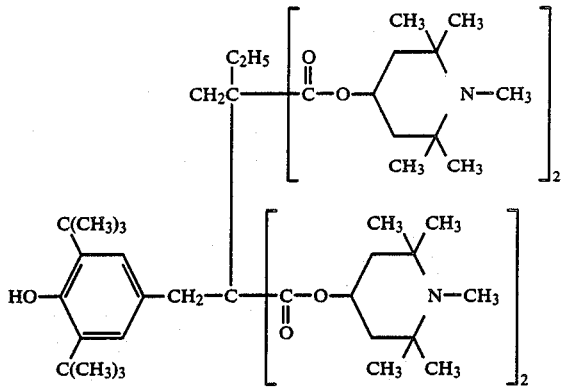
(V-44)
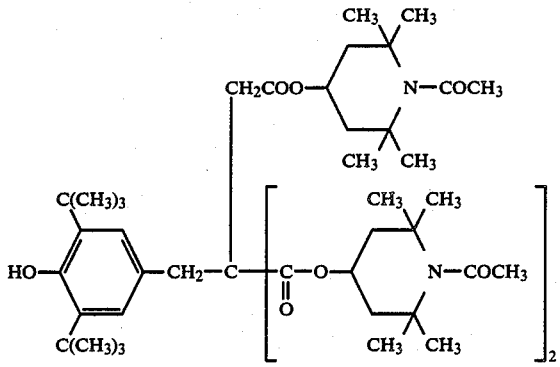
(V-45)
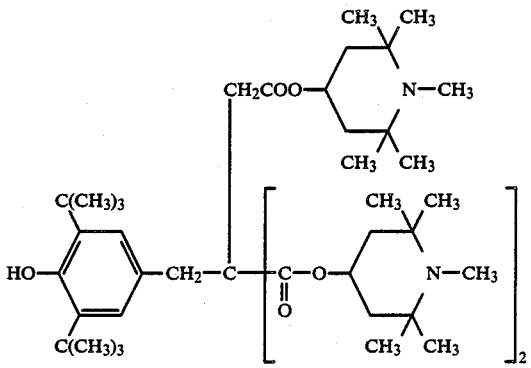
(V-46)
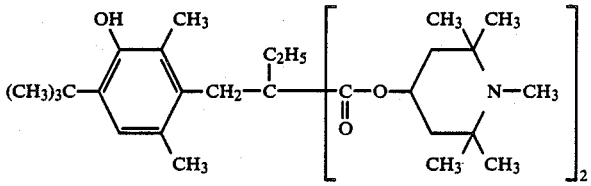
(V-47)
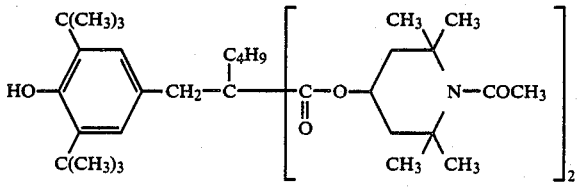

-continued
(V-48)
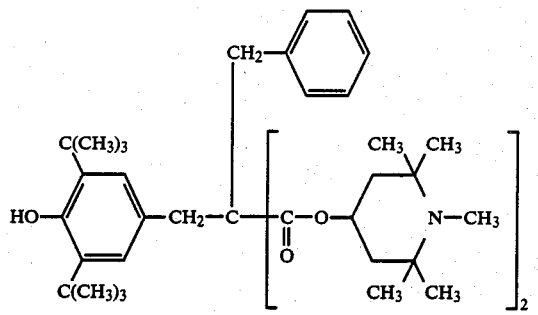
(V-49)
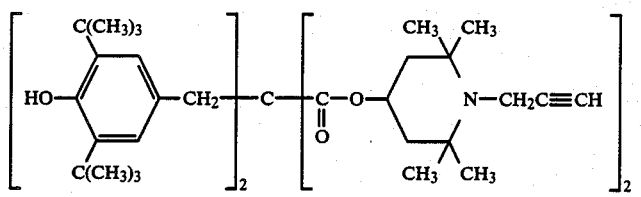
(V-50)
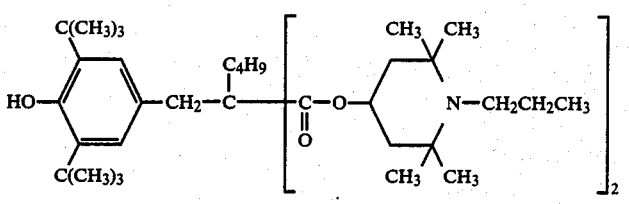
(V-51)
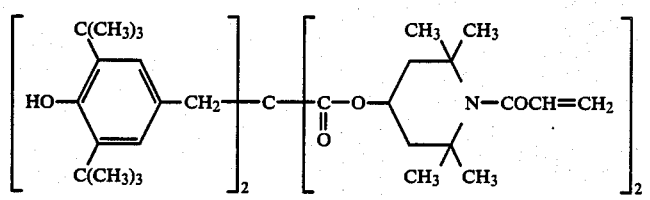
(V-52)
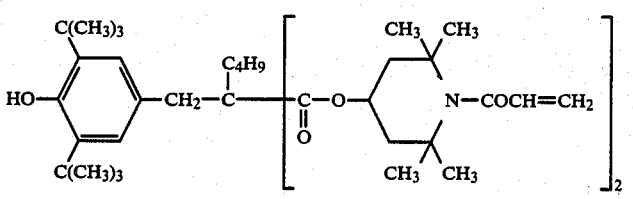
(V-53)
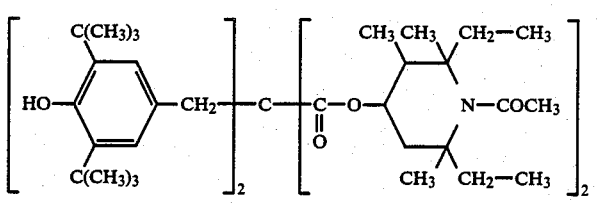
(V-54)
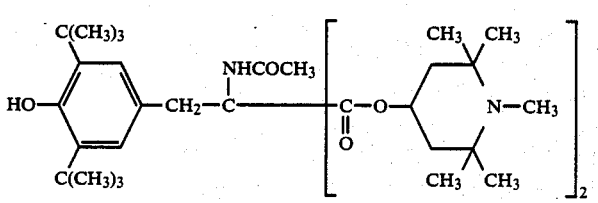

-continued (V-55)

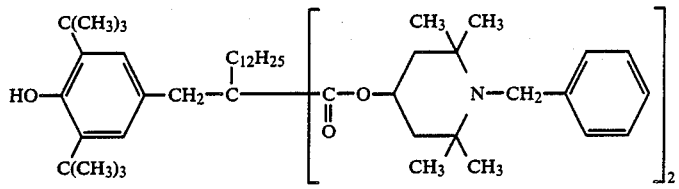

(V-56)

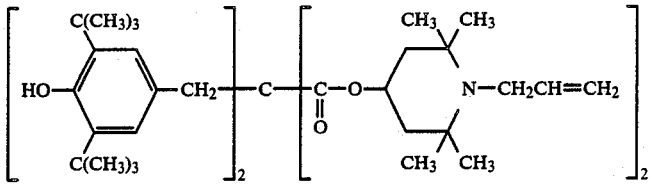

(V-57)

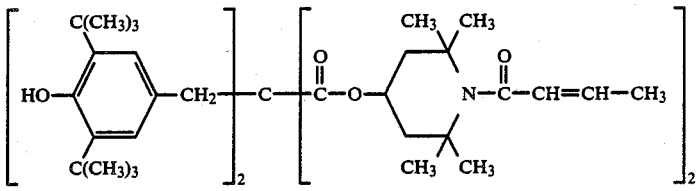

(V-58)

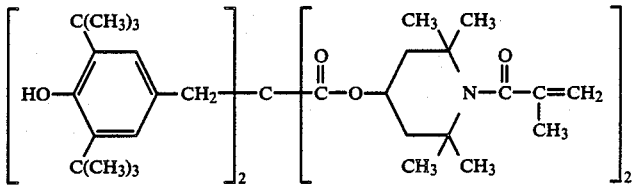

(V-59)

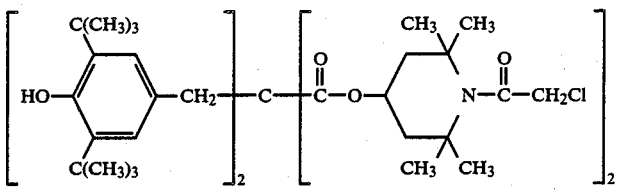

The silver halide photographic material of the present invention comprises a support having formed thereon, in sequence, a silver halide emulsion layer incorporating the yellow coupler of formula (I), a silver halide emulsion layer incorporating the magenta coupler of formula (II), and a silver halide emulsion layer incorporating the cyan coupler of formula (III). The number of the silver halide emulsion layers that can be used in the photographic material of the present invention is not limited to any particular number. The sensitive silver halide emulsion layers are typically interposed by non-sensitive hydrophilic colloidal layers. Typical examples of the silver halide photographic material of the present invention include color positive or negative films, color papers, color slides and black-and white sensitive materials using dye images. The photographic material of the present invention is particularly suitable for use as a color paper. Typically, most of the silver halide emulsion layers and non-sensitive layers are formed as hydrophilic colloidal layers containing hydrophilic binders. Such hydrophilic binders are preferably made of gelatin, or gelatin derivatives such as acylated gelatin, guanidylated gelatin, carbamylated gelatin, cyanoethanolated gelatin and esterified gelatin.

Each of the couplers represented by formulas (I), (II) and (III) is incorporated in a silver halide emulsion layer in an amount of about 0.05 to 2 mols, preferably 0.1 to 1 mol, per mol of silver halide. Any of the compounds represented by formulas [IV] and [V] in the present invention is incorporated in the silver halide emulsion layer in an amount of 5 to 300, preferably 10 to 100, parts by weight to 100 parts by weight of the cyan coupler represented by formula [III] in the present invention.

The silver halide photographic material of the present invention may assume any of the layer arrangements known in the art. A typical multi-color silver halide photographic material comprises a support which carries a cyan dye image forming unit having at least one red-sensitive silver halide emulsion layer containing one or more cyan couplers (at least one of the cyan couplers incorporated in the emulsion layer is the cyan coupler represented by formula (III)), a magenta dye image forming unit having at least one green-sensitive silver halide emulsion layer containing one or more magenta couplers (at least one of the magenta couplers incorporated in the emulsion layer is the magenta coupler represented by formula (II)), and a yellow dye image forming unit having at least one blue-sensitive silver halide emulsion layer containing one or more yellow couplers (at least one of the yellow couplers incorporated in the emulsion layer is the yellow coupler represented by formula (I)).

The photographic element of the present invention may contain additional non-sensitive layers such as a filter layer, an intermediate layer, a protective layer, an antihalation layer and a subbing layer.

Dispersions of the non-diffusing couplers for use in the silver halide photographic material of the present invention may be prepared by known methods such as by dispersing them in an aqueous alkali, a solid, a latex or in an oil in-water emulsion. A suitable method may be selected depending upon the chemical structure of the non-diffusing coupler of interest.

For the purposes of the present invention, dispersion in a latex or an oil-in-water emulsion is particularly effective. Both techniques are well known in the art. The method of dispersing in a latex and the resulting advantages are shown in Japanese Patent Application Nos. 74538/1974, 59943/1976, 32552/1979, and Research Disclosure, August, 1976, No. 14850, pp. 77–79. Latices suitable for use are homopolymers, copolymers and terpolymers of such monomers as styrene, ethyl acrylate, n-butyl acrylate, n-butyl methacrylate, 2-acetoacetoxyethyl methacrylate, 2-(methacryloyloxy)ethyl trimethyl ammonium methosulfate, sodium 3-(methacryloyloxy)propane-1-sulfonate, N-isopropylacrylamide, N-[2-(2-methyl-4-oxopentyl)] acrylamide and 2-acrylamido-2-methylpropanesulfonic acid.

Dispersing in an oil-in-water emulsion may be accomplished by the known method of preparing a dispersion of a hydrophobic additive such as a coupler. For example, the coupler of interest is dissolved in a high-boiling organic solvent with a boiling of about 175° C. or more, optionally together with a low-boiling solvent. The resulting solution is mixed with an aqueous solution of a hydrophilic binder such as gelatin in the presence of a surfactant, thereby forming finely dispersed particles of the coupler. The so prepared dispersion is added to a hydrophilic colloidal layer. This process is hereunder described in more details. A high-boiling solvent is first provided. This solvent is selected from among organic acid amides, carbamates, esters, ketones and urea derivatives, and particularly suitable solvents are phthalic acid esters such as dimethyl phthalate, diethyl phthalate, dipropyl phthalate and dibutyl phthalate, or phosphoric acid esters such as trimethyl phosphate, triethylphosphate, tripropyl phosphate and tricresyl phosphate. The coupler of interest according to the present invention is dissolved in one of these high-boiling solvents, optionally together with a low-boiling solvent such as methyl acetate, ethyl acetate, propyl acetate, butyl acetate, butyl propionate, cyclohexanol, cyclohexanetetrahydrofuran, methyl alcohol, ethyl alcohol, acetonitrile, dimethylformamide, dioxane, methyl ethyl ketone, methyl isobutyl ketone, diethylene glycol monoacetate, acetylacetone, nitromethane, nitroethane, carbon tetrachloride and chloroform. Such high-boiling and low-boiling solvents may be used either alone or in admixture with themselves. Subsequently, the resulting solution is mixed with an aqueous solution of a hydrophilic binder such as gelatin in the presence of an anionic surfactant such as alkylbenzenesulfonic acid or alkylnaphthalenesulfonic acid and/or a nonionic surfactant such as sorbitan sesquioleic acid ester or sorbitan monolauric acid ester. The mixture is then dispersed in a high-speed mixer, colloid mill or an ultrasonic disperser, and the so prepared dispersion is incorporated in an emulsion layer.

The emulsion layer may also contain other hydrophobic compound such as hydroquinone derivatives, UV absorbers, and anti-discoloration agents.

Each of the silver halide emulsion layers in the silver halide photographic material of the present invention may have incorporated therein any of the silver halides that are commonly employed in silver halide photographic materials, such as silver chloride, silver bromide, silver iodide, silver chlorobromide, silver iodobromide and silver chloroiodobromide. These silver halides may be used either as coarse or as fine grains, and the grain size distribution may be narrow or broad. The silver halide grains may be normal crystals or twins, with the proportions of (100) and (111) planes being selected at suitable values. The crystals of the silver halide grains may have a homogeneous internal structure, or they may have different internal and surface structures. The silver halides may be of such a type that a latent image is principally formed on the surface or of such a type that the image is formed within the grain. Such silver halide grains may be prepared by any of the methods known in the art.

The silver halide emulsions used in the silver halide photographic material of the present invention are preferably freed of soluble salts, but those from which no soluble salts have been removed may also be used. Two or more silver halide emulsions may be separately prepared and later mixed for incorporation in the silver halide photographic material of the present invention.

Known binders may be used in the silver halide emulsion layers, as well as in non-sensitive layers. Binders that can be used with advantage include gelatin, and gelatin derivatives such as phenylcarbamylated gelatin, acylated gelatin, and phthalated gelatin. These binders may be used as a mixture of two or more miscible compounds.

The silver halide emulsion having silver halide grains dispersed in a binder solution may be sensitized with a chemical sensitizer. Chemical sensitizers that can be used with advantage in the present invention are classified as noble metal sensitizers, sulfur sensitizers, selenium sensitizers and reduction sensitizers. Usable noble metal sensitizers include gold compounds, as well as ruthenium, rhodium, palladium, iridium and platinum compounds. Gold compounds may be used in combination with ammonium thiocyanate and sodium thiocyanate. Suitable sulfur sensitizers are activated gelatin and sulfur compounds. Illustrative selenium sensitizers are activated and inactive selenium compounds. Exemplary reduction sensitizers include stannous salts, polyamine, bisalkylaminosulfide, silane compounds, iminoaminomethanesulfinic acid, hydrazinium salts and hydrazine derivatives.

Besides the additives shown above, the silver halide photographic material of the present invention may have incorporated therein any useful photographic addenda such as a stabilizer, development accelerator, hardener, surfactant, anti-fouling agent, lubricant, DIR compound, and a brightener. The silver halide photographic material of the present invention may also use a backcoat in addition to the silver halide emulsion layers and non-sensitive layers.

Examples of the support that can be used in the present invention include baryta paper, polyethylene coated paper, synthetic polypropylene paper, a transparent support with a reflective layer or a reflector, glass plate, a polyester film made of cellulose acetate, cellulose nitrate or polyethylene terephthalate, polyamide film, polycarbonate film, and a polystyrene film. A suitable support is properly selected depending upon the specific use of the silver halide photographic material prepared according to the present invention.

The silver halide photographic material of the present invention is treated for color development by the usual method. First, the material is treated with a color developer containing a color developing agent. Alternatively, the sensitive material containing a color developing agent or a precursor therefor is treated with an "activator" solution. The so treated material is subjected to bleaching and fixing steps by the conventional method. The three steps, ie, color development with a color developer or an activator solution, bleaching and fixing, may be performed independently; alternatively, two or more steps may be accomplished by a single bath composed of a processing solution capable of fulfilling the respective functions. For example, bleaching and fixing agents of the types described later in this specification may be incorporated in the color developer or activator solution to make up a monobath. Alternatively, the color-developed photographic material may be processed with a bleach-fixing bath containing both bleaching and fixing agents.

Following the treatment with the color developer or activator solution, the photographic material may be immediately treated with a bleach-fixing bath for desilvering purposes. If desired, an acid stopping step may be inserted between color development and bleaching, and between bleaching and fixing steps. An acid stop bath may be composed of an aqueous solution of acetic acid or citric acid. If necessary, additional steps may be included, such as prehardening, neutralization, washing and stabilizing steps.

As a result of the color development processing shown above, a dye image is formed on the light-sensitive printing material because of the coupling reaction.

The color developing agent suitable for use with the silver halide photographic material of the present invention is typically made of aromatic primary amine compounds, which include aminephenol and p-phenylenediamine derivatives. These compunds are used either in the free state or as salts thereof with organic acids such as hydrochloric acid, sulfuric acid, p-toluenesulfonic acid, tetraphenylboric acid and p-(t-octyl)benzenesulfonic acid.

Specific examples of the aromatic primary amine compounds suitable for use as color developing agent in the present invention include o-aminophenol, p-aminophenol, 5-amino-2-oxytoluene, 2-amino-3-oxytoluene, 2-oxy-3-amino-1,4-dimethylbenzene, N,N-diethyl-p-phenylenediamine hydrochloride, N-methyl-p-phenylenediamine hydrochloride, N,N-dimethyl-p-phenylenediamine hydrochloride, N-ethyl-N-β-methanesulfonaminoethyl-3-methyl-4-aminoaniline and sulfate salt thereof, N-ethyl-N-β-hydroxyethylaminoaniline, N-N-diethyl-3-(β-methanesulfonamidoethyl)-4-aminoaniline hydrochloride, 4-amino-N-(2-methoxyethyl)-N-ethyl-3-methylaniline-p-toluenesulfonate salt, N-ethyl-N-β-methanesulfonamidoethyl-3-methyl-4-aminoaniline tetraphenyl borate salt, 4-amino-N-(2-methoxyethyl)-N-ethyl-3-methylaniline tetraphenyl borate salt, p-morpholinoaniline, p-piperidinoaniline, and 4-amino-N,N-diethyl-3-chloroaniline.

The silver halide photographic material of the present invention may optionally contain a precursor for the color developing agent shown above. The precursor is a compound that is capable of forming the color developing agent of interest under alkaline conditions, and illustrative examples include a Schiff base with an aromatic aldehyde derivative, polyvalent metal ion complex, phthalylimide derivative, phosphorylamide derivative, sugar-amine reaction product, and urethane. More specific examples of the precursors for aromatic primary amine color developing agents are shown in U.S. Pat. Nos. 3,342,599, 2,507,114, 2,695,234, 3,719,492, British Pat. No. 803,783, Japanese Unexamined Published Patent Application Nos. 135628/1978, 79035/1979, and Research Disclosure Nos. 15159, 12146 and 13924.

The aromatic primary amine compounds shown above are typically contained in the color developer in an amount of about 1–20 g/1,000 ml. If they are incorporated in the photographic material as precursors, their amount ranges from about 0.5 to 3 mols per mol of silver halide.

The color developer or activator solution used with the silver halide photographic material of the present invention may contain an alkali agent such as potassium hydroxide, sodium hydroxide, sodium carbonate, potassium carbonate, tertiary sodium phosphate, or tertiary potassium phosphate; a sulfite such as sodium sulfite or potassium sulfite; or a bromide such as sodium bromide, potassium bromide or ammonium bromide. Other additives that may also be incorporated in the color developer or activator solution include known development restrainers, thiocyanates such as sodium thiocyanate, potassium thiocyanate and ammonium thiocyanate; chlorides such as ammonium chloride, potassium chloride, and sodium chloride; organic solvents such as ethylene glycol, diethylene glycol, methanol, ethanol, n-butanol, benzyl alcohol, acetone, and dimethylformamide; amines such as hydroxylamine, ethanolamine, ethylenediamine, and diethanolamine; water softeners such as sodium hexametaphosphate, sodium tripolyphosphate, ethylenediaminetetraacetic acid and diethylenetriamine pentaacetic acid; and water-soluble brighteners.

The color developer or activator solution used in the present invention may also contain an auxiliary developer. A preferred auxiliary developer is a 1-aryl-3-pyrazolidone derivative which is typically used in an amount of 1 mg to 1 g, preferably from 10 mg to 500 mg, in 1,000 ml of the color developer or activator solution. Typical auxiliary developers include 1-phenyl-3-pyrazolidone, 4-methyl-1-phenyl-3-pyrazolidone, 4,4-dimethyl-1-phenyl-3-pyrazolidone, 4-methyl-4-hydroxymethyl-1-phenyl-3-pyrazolidone and 4-methyl-4-hydroxymethyl-1-(p-tolyl)-3-pyrazolidone.

The color developer or activator solution used in the present invention is held alkaline by a conventional method, and the concentration of hydroxyl ions in the developer or activator solution may be properly selected depending upon the type, composition, object and use of the photographic material under processing of the present invention. Typically, the color developer or activator solution has a pH in the range of 9.5 to 13.5.

The color developer or activator solution is typically used within a certain temperature range, which is properly selected depending upon the type, composition, object and use of the photographic material under processing of the present invention. The preferred temperature range is from 15° to 70° C., with the range of 30° to 50° C. being more preferred.

Known compounds may be used as a bleaching agent in the bleaching or bleach-fixing bath, and suitable examples are aminopolycarboxylic acid iron (III) complex salts such as EDTA sodium iron (III) salt and EDTA ammonium iron (III) salt; and persulfate salts such as ammonium persulfate and sodium persulfate. Known compounds may also be used as a fixing agent in the fixing or bleach-fixing bath, and suitable examples are thiosulfate salts such as sodium thiosulfate and ammonium thiosulfate; water-soluble sulfur containing diols such 3,6-dithia-1,8-octanediol and 3,6,9,12-tetrathia-1,14-tetradecanediol; and water-soluble sulfur containing dibasic acids or salts such as ethylene-bis-thioglycolic acid and sodium ethylene-bis-thioglycolate.

The advantages of the present invention are hereunder described in greater detail by reference to working examples, to which the scope of the present invention is by no means limited.

EXAMPLE 1

Multi-color photographic elements were prepared by forming the following layers on a support made of polyethylene coated paper, with the first layer positioned closest to the support.

First layer:

A yellow coupler containing blue-sensitive silver chlorobromide (90 mol% silver bromide) emulsion layer coated to give a gelatin deposition of 2 g/m$^2$; this layer contained 300 g of gelatin per mol of silver halide, as well as 0.5 mol, per mol of silver halide, of one of the yellow couplers in Table 1 or comparative coupler Y-A shown below, which were dispersed as a dibutyl phthalate solution.

Second layer:

First intermediate layer (gelatin layer with a gelatin deposition of 1.5 g/m$^2$).

Third layer:

A magenta coupler containing green-sensitive silver chlorobromide (80% mol% silver bromide) emulsion layer coated to give a gelatin deposition of 2 g/m$^2$; this layer contained 400 g of gelatin per mol of silver halide as well as 0.3 mol, per mol of silver halide, of one of the magenta couplers shown in Table 1 that were dispersed as a dibutyl phthalate solution.

Fourth layer:

Second intermediate layer containing a UV absorber; in this layer, UV absorber, UV-1 shown below, was dispersed in gelatin as a solution in 20 g of dibutyl phthalate, and its coating thickness was such that the UV absorber and gelatin deposits were 0.6 g/m$^2$ and 1.5 g/m$^2$, respectively.

Fifth layer:

A cyan coupler containing red-sensitive silver chlorobromide (80 mol% silver bromide) emulsion layer coated to give a gelatin deposit of 20 g/m$^2$; this layer contained 300 g of gelatin per mol of silver halide, as well as 0.4 mol, per mol of silver halide, of one of the cyan couplers in Table 1 or comparative cyan couplers C-A and C-B shown below, which were dispersed as a dibutyl phthalate solution.

Sixth layer:

Protective layer (gelatin layer with a gelatin deposit of 1.5 g/m$^2$).

Sample Nos. 1–11 thus prepared were exposed through an optical wedge with a sensitometer (Model KS-7 of Konishiroku Photo Industry Co., Ltd.) and were thereafter subjected to the following steps.

| Treatments | Temperature | Period |
|---|---|---|
| Color development | 32.8° C. | 3 min and 30 sec |
| Bleach-fixing | 32.8° C. | 1 min and 30 sec |
| Washing | 32.8° C. | 3 min and 30 sec |

The following formulations were used in the steps of color development and bleach-fixing.

Color developer

| Components | Amount |
|---|---|
| N—ethyl-N—β-methanesulfonamidoethyl-3-methyl-4-aminoaniline sulfate | 4.0 g |
| Hydroxylamine sulfate | 2.0 g |
| Potassium carbonate | 25.0 g |
| Sodium carbonate | 0.1 g |
| Sodium bromide | 0.2 g |
| Anhydrous sodium sulfite | 2.0 g |
| Benzyl alcohol | 10.0 ml |
| Polyethylene glycol (average degree of polymerization = 400) | 3.0 ml |
| Water to make | 1,000 ml |
| pH adjusted to 10.0 with sodium hydroxide. | |

Bleach-fixing solution

| Components | Amount |
|---|---|
| Ethylenediaminetetraacetic sodium iron (III) salt | 60.0 g |
| Thiosulfate | 100.0 g |
| Sodium bisulfite | 20.0 g |
| Sodium metabisulfite | 5.0 g |
| Water to make | 1,000 ml |
| pH adjusted to 7.0 with sulfuric acid. | |

Oxidation-reduction potential—70 mV.

The gray dye images formed on the respective samples as a result of the photographic processing were checked for their resistance to light and dark discolorations by the following tests.

(1) Light discoloration

The processed samples were exposed to a Xenon fademeter ($5\times10^4$ lux) for 6 weeks at 55° C. with no control over the moisture content. Thereafter, the residual blue, green and red densities (%) of the gray dye image in each sample with the initial densities taken as 1.0 were measured with a Sakura Color densitometer (Model PDA-60 of Konishiroku Photo Industry Co., Ltd.). The results are listed in Table 1 in the column of "Light discoloration".

(2) Dark discoloration

The samples were left for 2 weeks in a chamber controlled at 77° C. and 40% r.h. The percent changes from the blue, green and red densities (1.0) of the gray dye image in each sample were measured as in (1). The results are also listed in Table 1 in the column of "Dark discoloration". Comparative cyan coupler, C-A (U.S. Pat. No. 2,423,730):

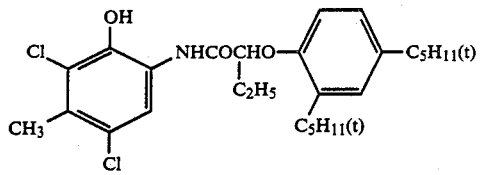

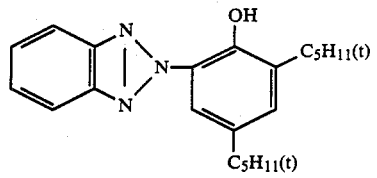

TABLE 1

| Sample No. | Yellow coupler | Magenta coupler | Cyan coupler | Light discoloration (%) C*1 | M*2 | Y*3 | Dark discoloration (%) C*1 | M*2 | Y*3 | Remarks |
|---|---|---|---|---|---|---|---|---|---|---|
| 1 | Y-7 | M-22 | C-A | 65 | 74 | 72 | 63 | 98 | 99 | Comparative sample |
| 2 | Y-7 | M-22 | C-B | 51 | 72 | 71 | 100 | 99 | 100 | Comparative sample |
| 3 | Y-A | M-22 | C-A | 65 | 70 | 61 | 64 | 98 | 97 | Comparative sample |
| 4 | Y-7 | M-22 | C-2 | 75 | 73 | 74 | 100 | 99 | 99 | Sample of the present invention |
| 5 | Y-7 | M-22 | C-1 | 74 | 74 | 75 | 100 | 100 | 99 | Sample of the present invention |
| 6 | Y-23 | M-22 | C-2 | 74 | 75 | 75 | 100 | 99 | 99 | Sample of the present invention |
| 7 | Y-23 | M-22 | C-1 | 75 | 74 | 74 | 100 | 100 | 99 | Sample of the present invention |
| 8 | Y-7 | M-8 | C-2 | 74 | 75 | 75 | 100 | 98 | 100 | Sample of the present invention |
| 9 | Y-23 | M-8 | C-2 | 74 | 74 | 74 | 100 | 97 | 99 | Sample of the present invention |
| 10 | Y-35 | M-8 | C-1 | 74 | 75 | 74 | 100 | 97 | 99 | Sample of the present invention |
| 11 | Y-23 | M-33 | C-2 | 74 | 74 | 75 | 100 | 97 | 99 | Sample of the present invention |
| 12 | Y-34 | M-8 | C-21 | 74 | 74 | 75 | 100 | 97 | 99 | Sample of the present invention |
| 13 | Y-36 | M-46 | C-2 | 75 | 75 | 75 | 100 | 97 | 99 | Sample of the present invention |

*1C: Residual red density (%) of the gray image
*2M: Residual green density (%) of the gray image
*3Y: Residual blue density (%) of the gray image.

Comparative cyan coupler, C-B (Japanese Unexamined Published Patent Application No. 109630/1978):

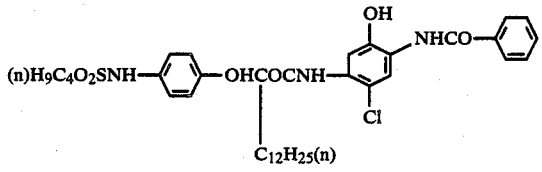

Comparative yellow coupler, Y-A (U.S. Pat. No. 3,408,194);

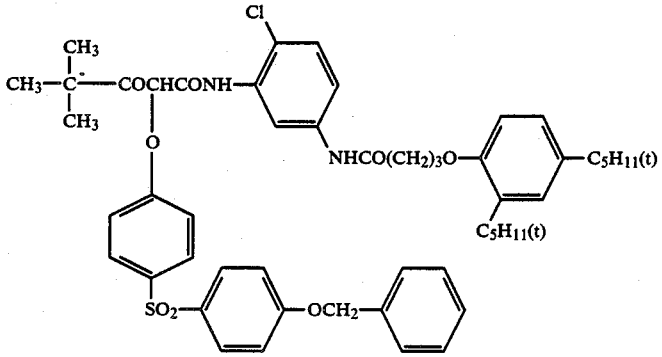

UV absorber UV-1;

As Table 1 shows, sample No. 1 using comparative cyan coupler C-A had a very low resistance to dark discoloration. Sample No. 2 using comparative cyan coupler C-B had an improved resistance to dark discoloration but its resistance to light discoloration was not satisfactory. As a result, sample No. 1 did not have a good balance in dark discoloration while sample No. 2 did not have a good balance in light discoloration. Both samples were poor in their overall ability to keep dye images of good quality.

Sample No. 3 using comparative yellow coupler Y-A did not have a good balance in either light or dark discoloration, and hence its overall ability to keep dye images of good quality was also low. Sample Nos. 4 to 11 using the yellow, magenta and cyan couplers of the present invention produced cyan dye images which had a particularly great improvement in resistance to both light and dark discolorations. Therefore, these samples according to the present invention displayed a good balance in discoloration between cyan, magenta and yellow colors, and they had an improved overall ability to keep dye images of good quality.

EXAMPLE 2

Sample Nos. 12 to 21 were prepared as in Example 1 except that the sixth layer was underlaid with a non-sensitive layer containing 0.3 g/m$^2$ of UV absorber (UV-1) that was coated to give a gelatin deposit of 1.5 g/m$^2$. These samples were checked for their resistance to light and dark discolorations as in Example 1. The results are shown in Table 2.

TABLE 2

| Sample No. | Yellow coupler | Magenta coupler | Cyan coupler | Light discoloration (%) C*1 | M*2 | Y*3 | Dark discoloration (%) C*1 | M*2 | Y*3 | Remarks |
|---|---|---|---|---|---|---|---|---|---|---|
| 14 | Y-7 | M-22 | C-A | 68 | 76 | 77 | 63 | 98 | 99 | Comparative sample |
| 15 | Y-7 | M-22 | C-B | 57 | 73 | 74 | 100 | 99 | 100 | Comparative sample |
| 16 | Y-A | M-22 | C-A | 70 | 73 | 67 | 64 | 98 | 97 | Comparative sample |
| 17 | Y-7 | M-22 | C-2 | 81 | 80 | 80 | 100 | 99 | 99 | Sample of the present invention |
| 18 | Y-7 | M-22 | C-1 | 79 | 81 | 80 | 100 | 100 | 99 | Sample of the present invention |
| 19 | Y-23 | M-22 | C-2 | 81 | 80 | 81 | 100 | 99 | 99 | Sample of the present invention |
| 20 | Y-23 | M-22 | C-1 | 80 | 80 | 81 | 100 | 100 | 99 | Sample of the present invention |
| 21 | Y-7 | M-8 | C-2 | 81 | 80 | 80 | 100 | 97 | 100 | Sample of the present invention |
| 22 | Y-23 | M-8 | C-2 | 81 | 79 | 80 | 100 | 98 | 99 | Sample of the present invention |
| 23 | Y-35 | M-8 | C-1 | 79 | 79 | 79 | 100 | 98 | 99 | Sample of the present invention |
| 24 | Y-23 | M-33 | C-2 | 79 | 80 | 80 | 100 | 97 | 99 | Sample of the present invention |
| 25 | Y-34 | M-8 | C-21 | 80 | 79 | 80 | 100 | 97 | 99 | Sample of the present invention |
| 26 | Y-36 | M-46 | C-2 | 80 | 79 | 79 | 100 | 98 | 99 | Sample of the present invention |

Remarks: *1C, *2M and *3Y are the same as in Table 1.

As Table 2 shows, Sample Nos. 12 to 14 using comparative cyan couplers C-A and C-B and which had a protective layer formed on the UV absorbing layer exhibited some improvement in resistance to light discoloration, but their overall balance in discoloration between cyan, magenta and yellow colors was still poor. On the other hand, sample Nos. 15 to 22 according to the present invention had an improved resistance to light discoloration and their overall balance in discoloration in the three colors was satisfactory. In addition, they retained the high resistance to dark discoloration possessed by sample Nos. 4 to 11 prepared in Example 1. Therefore, these samples according to the present invention had a good balance in both light and dark discolorations between cyan, magenta and yellow colors, and hence they displayed an improved overall ability to keep dye images of good quality.

EXAMPLE 3

Samples Nos. 23 to 26 were prepared as in Example 2 except for the fifth layer. The fifth layer comprised a cyan coupler-containing red-sensitive silver chlorobromide (70 mol% silver bromide) emulsion layer coated to give a gelatin deposit of 20 g/m$^2$; this layer contained 300 g of gelatin per mol of silver halide, as well as 0.4 mol, per mol of silver halide, of cyan coupler, C-2 of the present invention dissolved in dibutyl phthalate and dispersed in gelatin and 35 parts by weight, per 100 parts by weight of cyan coupler, of the dye image stabilizer as in Table 3.

The processed samples 23 to 26 were tested for light and dark discoloration under the same conditions as in Example 1 except that, for light discoloration, the samples were exposed to a xenon fade-meter for 9 weeks and, for dark discoloration, the samples were left alone for 4 weeks in a chamber kept at constant temperature and moisture. The results are shown in Table 3.

TABLE 3

| | Yellow coupler | Magenta coupler | Cyan coupler | Red image stabilizer | Light discoloration (%) C | M | Y | Dark discoloration (%) C | M | Y |
|---|---|---|---|---|---|---|---|---|---|---|
| 23 | Y-7 | M-22 | C-2 | IV-47 | 69 | 70 | 69 | 92 | 92 | 92 |
| 24 | " | " | " | IV-65 | 70 | 71 | 70 | 93 | 91 | 93 |
| 25 | " | " | " | V-34 | 69 | 69 | 70 | 93 | 92 | 93 |
| 26 | " | " | " | V-37 | 68 | 69 | 69 | 93 | 92 | 92 |

As Table 3 shows, the samples of the present invention, even when exposed to light for a prolonged period, retain a good balance in the discoloration of yellow, magenta and cyan dye images, and are superior in the overall retention of dye images.

What is claimed is:

1. A silver halide photographic material having formed on a support in sequence a silver halide emulsion layer incorporating a yellow coupler of the formula (I), a silver halide emulsion layer incorporating a magenta coupler of the formula (II), and a silver halide emulsion layer incorporating a cyan coupler of the formula (III):

(I)

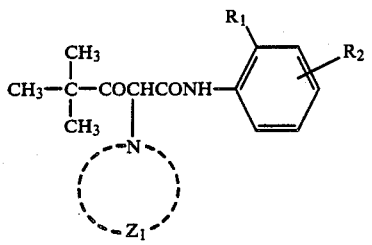

(wherein $R_1$ is a hydrogen atom, a halogen atom or an alkoxy group; $R_2$ is —$NHCOR_3$, —$NHSO_2R_3$, —$COOR_3$ or $$-SO_2\underset{\underset{R_4}{|}}{N}-R_3,$$

provided that $R_3$ and $R_4$ are each an alkyl group; and $Z_1$ is a non-metallic atomic group necessary to form a 5- or 6-membered hetero ring together with a nitrogen atom);

(II)

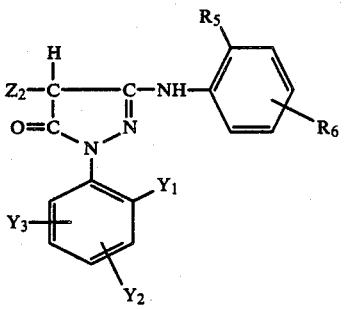

[wherein $R_5$ is a hydrogen atom, a halogen atom or an alkoxy group having 1 to 4 carbon atoms; $R_6$ is

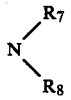

(provided that $R_7$ $R_8$ are each a hydrogen atom or an acyl group, and when $R_7$ and $R_8$ are each an acyl group, they may be combined to form a 5-membered hetero ring together with a nitrogen atom), an alkyl- or arylsulfonamido group, an alkyl- or arylsulfamoyl group or an alkyl- or arylcarboxylic acid ester group; $Y_1$, $Y_2$ and $Y_3$ are each a hydrogen atom, a halogen atom, an alkyl group, an alkoxy group, a carboxy group, an alkoxycarbonyl group, a nitro group, an aryloxy group, a cyano group or an acylamino group; and $Z_2$ is an atom or a group that leaves when it enters into coupling reaction with the oxidation product of a color developing agent];

(III)

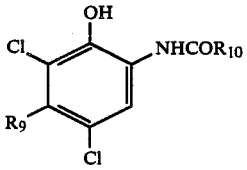

(wherein $R_9$ is a straight- or branched-chain alkyl group having 2 to 4 carbon atoms; and $R_{10}$ is a ballast group).

2. A silver halide photographic material according to claim 1, wherein $R_9$ in said formula (III) is an ethyl group.

3. A silver halide photographic material according to claim 1, wherein $R_{10}$ in said formula (III) is a group represented by the following formula:

$$-\underset{\underset{R_{11}}{|}}{CH}-O-Ar$$

wherein $R_{11}$ is a hydrogen atom or an alkyl group having 1 to 12 carbon atoms; and Ar is an aryl group.

4. A silver halide photographic material according to claim 1, wherein $R_2$ of said formula (I) is in the para-position of the benzene ring with respect to $R_1$.

5. A silver halide photographic material according to claim 1, wherein $Y_1$, $Y_2$ and $Y_3$ in said formula (II) are each a halogen atom.

6. A silver halide photographic material according to claim 1, wherein $Z_2$ in said formula (II) is a halogen atom, an alkylthio group or an arylthio group.

7. A silver halide photographic material according to claim 1, which comprises, in sequence on the support, a blue-sensitive silver halide emulsion layer containing a yellow coupler represented by said formula (I), a green-sensitive silver halide emulsion layer containing a magenta coupler represented by said formula (II) and a red-sensitive silver halide emulsion layer containing a cyan coupler represented by said formula (III).

8. The silver halide photographic material according to claim 1 wherein said cyan coupler of Formula III is be combined with at least one of the compounds represented by the following formulas (IV), (V) and (VI):

[IV]

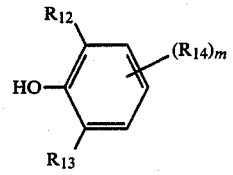

wherein $R_{12}$ and $R_{13}$ are each an alkyl group; $R_{14}$ is a hydrogen atom, an alkyl group, —$NR'_{13}R''_{13}$, —$SR'_{13}$ or —$COOR''_{13}$ (wherein $R'_{13}$ is a monovalent organic group, and $R''_{13}$ is a hydrogen atom or a monovalent organic group); and m is an integer of 0 to 3;

[V]

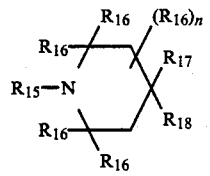

wherein $R_{15}$ is a hydrogen atom, a hydroxyl group, an oxyradical group (—$\dot{O}$), —$SOR'_{15}$, —$SO_2R''_{15}$ (wherein $R'_{15}$ and $R''_{15}$ are each a monovalent organic group), an alkyl group, an alkenyl group, an alkynyl group or —$COR'''_{15}$ (wherein $R'''_{15}$ is a hydrogen atom or a monvalent organic group); $R_{16}$ is an alkyl group; $R_{17}$ and $R_{18}$ are each a hydrogen atom or —OCOR' (whereinn R' is a monovalent organic group), or $R_{17}$ and $R_{18}$ may be joined to form a heterocyclic group;
and n is an integer of 0 to 4;
[VI]
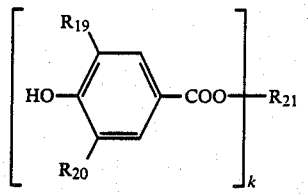
wherein $R_{19}$ and $R_{20}$ are each a straight- or branched-chain alkyl group having 3 to 8 carbon atoms; $R_{21}$ is an organic group having a valence of k; and k is an integer of 1 to 6.
* * * * *